US009232830B2

(12) United States Patent
Davis et al.

(10) Patent No.: US 9,232,830 B2
(45) Date of Patent: Jan. 12, 2016

(54) VENTILATION SYSTEM FOR AN ARTICLE OF FOOTWEAR

(71) Applicant: Nike, Inc., Beaverton, OR (US)

(72) Inventors: Carrie L. Davis, Portland, OR (US); Gregory R. Leedy, Milwaukie, OR (US); Grant Simmons, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 100 days.

(21) Appl. No.: 14/031,449

(22) Filed: Sep. 19, 2013

(65) Prior Publication Data

US 2015/0075036 A1 Mar. 19, 2015

(51) Int. Cl.

| | |
|---|---|
| ***A43B 7/08*** | (2006.01) |
| ***A43B 5/00*** | (2006.01) |
| ***A43B 13/14*** | (2006.01) |
| ***A43B 13/20*** | (2006.01) |

(52) U.S. Cl.

CPC . *A43B 7/088* (2013.01); *A43B 5/00* (2013.01); *A43B 7/081* (2013.01); *A43B 7/087* (2013.01); *A43B 13/145* (2013.01); *A43B 13/20* (2013.01); *A43B 13/203* (2013.01); *A43B 13/206* (2013.01)

(58) Field of Classification Search

CPC ..... A43B 7/087; A43B 5/00; A43B 13/20; A43B 13/203; A43B 13/206

USPC ..... 36/25 R, 29

See application file for complete search history.

(56) References Cited

U.S. PATENT DOCUMENTS

| | | | | |
|---|---|---|---|---|
| 853,336 | A | | 5/1907 | Ball |
| 1,852,883 | A | | 2/1929 | Gustaveson |
| 1,938,393 | A | | 11/1930 | Kelley |
| 2,441,879 | A | | 11/1945 | Gantt |
| 2,558,973 | A | | 2/1948 | Meaker |
| 2,751,692 | A | | 11/1954 | Cortina |
| 3,012,342 | A | | 7/1960 | Ramirez |
| 3,128,566 | A | * | 4/1964 | Burlison et al. ..... 36/3 R |
| 4,438,573 | A | | 3/1984 | McBarron |
| 4,602,441 | A | | 7/1986 | El Sakkaf |
| 4,763,426 | A | * | 8/1988 | Polus et al. ..... 36/29 |
| 4,813,160 | A | | 3/1989 | Kuznetz |
| 4,860,463 | A | | 8/1989 | Pin |
| 4,939,851 | A | | 7/1990 | Miller |

(Continued)

FOREIGN PATENT DOCUMENTS

| | | | |
|---|---|---|---|
| WO | 2007011096 | A1 | 1/2007 |
| WO | 2010099710 | A1 | 10/2010 |

(Continued)

*Primary Examiner* — Shaun R Hurley
*Assistant Examiner* — Bao-Thieu L Nguyen
(74) *Attorney, Agent, or Firm* — Plumsea Law Group, LLC

(57) ABSTRACT

A ventilation system for an article of footwear is disclosed. The ventilation system may be configured to direct air from outside the article of footwear to the inside of the article of footwear. The ventilation system may include a sole layer and a sockliner configured to lie on top of the sole layer. One or more paths may be formed within the sole layer to provide a pumping mechanism during the normal course of providing cushioning for the user. The paths may be activated by fore-foot or heel based pressure to force air from the exterior of the article of footwear to a sockliner directly above the sole layer. An air inlet extending through a sidewall of the sole layer may allow outside air to enter the path within the sole layer. An opening in the sockliner may allow air inside the path to enter inside the article of footwear.

17 Claims, 19 Drawing Sheets

(56) References Cited

U.S. PATENT DOCUMENTS

| | | | | |
|---|---|---|---|---|
| 4,991,317 | A * | 2/1991 | Lakic | 36/44 |
| 5,010,661 | A | 4/1991 | Chu | |
| 5,044,096 | A | 9/1991 | Polegato | |
| 5,179,792 | A * | 1/1993 | Brantingham | 36/29 |
| 5,299,368 | A | 4/1994 | Liu | |
| 5,341,581 | A * | 8/1994 | Huang | 36/3 B |
| 5,400,526 | A | 3/1995 | Sessa | |
| 5,515,622 | A | 5/1996 | Lee | |
| 5,598,644 | A | 2/1997 | Polegato | |
| 5,701,687 | A * | 12/1997 | Schmidt et al. | 36/29 |
| 5,826,349 | A | 10/1998 | Goss | |
| 5,956,869 | A * | 9/1999 | Kim | 36/29 |
| 5,983,524 | A | 11/1999 | Polegato | |
| 5,992,052 | A | 11/1999 | Moretti | |
| 6,009,637 | A * | 1/2000 | Pavone | 36/29 |
| 6,014,823 | A * | 1/2000 | Lakic | 36/93 |
| 6,041,518 | A | 3/2000 | Polycarpe | |
| 6,076,282 | A | 6/2000 | Brue | |
| 6,085,444 | A * | 7/2000 | Cho | 36/3 B |
| 6,098,313 | A * | 8/2000 | Skaja | 36/28 |
| 6,134,812 | A * | 10/2000 | Voss | 36/29 |
| 6,205,680 | B1 | 3/2001 | Clark | |
| 6,305,102 | B1 * | 10/2001 | Doyle | 36/29 |
| 6,370,799 | B1 * | 4/2002 | Thatcher | 36/3 B |
| 6,389,711 | B1 | 5/2002 | Polegato | |
| 6,408,541 | B1 | 6/2002 | Moretti | |
| 6,463,679 | B1 | 10/2002 | Buttigieg | |
| 6,487,891 | B2 | 12/2002 | Moretti | |
| 6,581,303 | B1 | 6/2003 | Tuan | |
| 6,604,302 | B2 | 8/2003 | Polegato Moretti | |
| 6,655,048 | B2 | 12/2003 | Moretti | |
| 6,681,500 | B2 | 1/2004 | Moretti | |
| 6,817,112 | B2 | 11/2004 | Berger et al. | |
| 6,823,609 | B2 | 11/2004 | Moretti | |
| 6,839,984 | B2 | 1/2005 | Polegato | |
| 6,874,251 | B2 | 4/2005 | Moretti | |
| 6,904,705 | B2 | 6/2005 | Polegato Moretti | |
| 6,918,695 | B2 | 7/2005 | Polegato Moretti et al. | |
| 6,986,215 | B2 | 1/2006 | Moretti | |
| 7,096,604 | B2 | 8/2006 | Polegato Moretti | |
| 7,210,248 | B2 | 5/2007 | Van Noy et al. | |
| 7,213,351 | B2 | 5/2007 | Polegato Moretti et al. | |
| 7,251,907 | B1 | 8/2007 | Bondarchuk | |
| 7,328,525 | B2 | 2/2008 | Lim | |
| 7,367,141 | B2 | 5/2008 | Polegato Moretti | |
| 7,370,382 | B2 | 5/2008 | Polegato Moretti | |
| D570,581 | S | 6/2008 | Polegato Moretti | |
| D572,440 | S | 7/2008 | Polegato Moretti | |
| D572,441 | S | 7/2008 | Moretti | |
| D572,442 | S | 7/2008 | Polegato Moretti | |
| 7,437,836 | B2 | 10/2008 | Kim | |
| D583,132 | S | 12/2008 | Polegato Moretti | |
| 7,487,602 | B2 | 2/2009 | Berger et al. | |
| 7,546,697 | B2 | 6/2009 | Polegato Moretti | |
| 7,559,157 | B2 | 7/2009 | Polegato Moretti | |
| 7,571,555 | B1 * | 8/2009 | Powell, Sr. | 36/3 B |
| 7,631,383 | B2 | 12/2009 | Polegato Moretti | |
| 7,716,851 | B2 | 5/2010 | Polegato Moretti | |
| 7,716,852 | B2 | 5/2010 | Berger et al. | |
| 7,793,426 | B2 | 9/2010 | Byrne et al. | |
| 7,823,297 | B2 | 11/2010 | Polegato Moretti | |
| 7,913,421 | B2 | 3/2011 | Malenotti | |
| 8,088,698 | B2 | 1/2012 | Polegato Moretti | |
| 8,127,465 | B2 | 3/2012 | Byrne et al. | |
| D657,119 | S | 4/2012 | Polegato Moretti | |
| 2002/0035794 | A1 * | 3/2002 | Doyle | 36/29 |
| 2003/0145488 | A1 | 8/2003 | Cardarelli | |
| 2003/0188451 | A1 * | 10/2003 | Wu | 36/3 B |
| 2004/0010939 | A1 * | 1/2004 | Liu et al. | 36/29 |
| 2004/0068891 | A1 * | 4/2004 | Wang | 36/27 |
| 2005/0000117 | A1 | 1/2005 | Polegato Moretti | |
| 2005/0005473 | A1 | 1/2005 | Oh | |
| 2005/0132612 | A1 * | 6/2005 | Kim | 36/44 |
| 2005/0241082 | A1 | 11/2005 | Moretti | |
| 2005/0241180 | A1 | 11/2005 | Squadroni | |
| 2005/0252035 | A1 | 11/2005 | Moretti et al. | |
| 2006/0156575 | A1 * | 7/2006 | Lo | 36/3 B |
| 2007/0089319 | A1 * | 4/2007 | Liao et al. | 36/3 R |
| 2007/0271815 | A1 | 11/2007 | Moretti et al. | |
| 2007/0275238 | A1 | 11/2007 | Moretti et al. | |
| 2007/0294916 | A1 * | 12/2007 | Park | 36/29 |
| 2008/0216358 | A1 | 9/2008 | Polegato Moretti | |
| 2008/0229623 | A1 * | 9/2008 | Ferretti | 36/3 B |
| 2008/0263899 | A1 * | 10/2008 | Lee | 36/102 |
| 2008/0295360 | A1 * | 12/2008 | Gazzola | 36/102 |
| 2009/0019726 | A1 * | 1/2009 | Gornatti | 36/29 |
| 2009/0049716 | A1 | 2/2009 | Romero | |
| 2009/0113762 | A1 | 5/2009 | Leimer et al. | |
| 2009/0151203 | A1 * | 6/2009 | Boyer et al. | 36/3 B |
| 2009/0188134 | A1 | 7/2009 | Polegato Moretti | |
| 2009/0193690 | A1 | 8/2009 | Moretti | |
| 2009/0199438 | A1 | 8/2009 | Polegato Moretti | |
| 2009/0211112 | A1 | 8/2009 | Polegato Moretti | |
| 2009/0211119 | A1 | 8/2009 | Moretti | |
| 2009/0277047 | A1 | 11/2009 | Polegato Moretti | |
| 2010/0005687 | A1 * | 1/2010 | Ramadoro | 36/3 B |
| 2010/0011624 | A1 | 1/2010 | Polegato Moretti | |
| 2010/0050480 | A1 | 3/2010 | Polegato Moretti | |
| 2010/0115792 | A1 | 5/2010 | Muller | |
| 2010/0132228 | A1 | 6/2010 | Polegato Moretti | |
| 2011/0005101 | A1 * | 1/2011 | Sills | 36/29 |
| 2011/0113655 | A1 | 5/2011 | Polegato Moretti | |
| 2011/0154693 | A1 | 6/2011 | Oberschneider | |
| 2011/0252667 | A1 | 10/2011 | Polegato Moretti | |
| 2011/0265352 | A1 | 11/2011 | Lin | |
| 2011/0283566 | A1 * | 11/2011 | Chou | 36/3 B |
| 2012/0030885 | A1 | 2/2012 | Moretti | |
| 2012/0036741 | A1 | 2/2012 | Polegato Moretti | |
| 2012/0048663 | A1 * | 3/2012 | McDonnell | 188/266 |
| 2012/0055042 | A1 | 3/2012 | Polegato Moretti | |
| 2012/0151804 | A1 | 6/2012 | Polegato Moretti | |
| 2012/0151805 | A1 | 6/2012 | Polegato Moretti | |
| 2012/0151806 | A1 | 6/2012 | Polegato Moretti | |
| 2012/0255198 | A1 * | 10/2012 | Langvin et al. | 36/29 |
| 2012/0285048 | A1 * | 11/2012 | Pan | 36/30 R |
| 2013/0067766 | A1 * | 3/2013 | Chou et al. | 36/43 |
| 2014/0182165 | A1 * | 7/2014 | Lee | 36/28 |
| 2014/0259750 | A1 * | 9/2014 | Yeh | 36/29 |
| 2015/0040425 | A1 * | 2/2015 | Adams | 36/29 |

FOREIGN PATENT DOCUMENTS

| | | | |
|---|---|---|---|
| WO | 2011023507 | A1 | 3/2011 |
| WO | 2011023509 | A1 | 3/2011 |
| WO | 2011023510 | A1 | 3/2011 |
| WO | 2011045210 | A2 | 4/2011 |
| WO | 2011098344 | A1 | 8/2011 |
| WO | 2012041637 | A1 | 4/2012 |
| WO | 2012065792 | A1 | 5/2012 |
| WO | 2012072379 | A1 | 6/2012 |

* cited by examiner

VENTILATION SYSTEM FOR AN ARTICLE OF FOOTWEAR

BACKGROUND

The present disclosure relates generally to an article of footwear and, more particularly, to a ventilation system for an article of footwear.

Over time, articles of footwear have been developed for numerous activities. Articles of footwear commonly lack sufficient ventilation. This problem is particularly common for articles of footwear used for strenuous activities. It would be advantageous for a sports shoe to have a ventilation system.

SUMMARY

A ventilation system for an article of footwear is disclosed. The ventilation system may direct air from outside the article of footwear to the inside of the article of footwear. In some embodiments, the ventilation system may include a sole layer and a sockliner configured to lie on top of the sole layer. Sockliner may be contoured to correspond to a top surface of the sole layer. In some embodiments, the sole layer may be a midsole. In some embodiments, the sole layer may be an insole. In embodiments in which an article of footwear has a one-piece sole, the sole layer may be the one-piece sole. One or more paths may be formed within the sole layer. The paths being formed within the sole layer may provide a pumping mechanism during the normal course of providing cushioning for the user. The paths may be activated by forefoot or heel based pressure to force air from the exterior of the article of footwear, through the paths, and to a sockliner directly above the sole layer. An air inlet extending through a sidewall of the sole layer may allow air to enter the path from outside the article of footwear. An opening in the sockliner may allow air inside the path to enter inside the article of footwear. In some embodiments, one or more of the paths may include valves to control the flow of air in and out of the paths. In some embodiments, the paths may include filters preventing debris and/or liquid from entering the article of footwear. In some embodiments, a reservoir may be disposed within a path to provide a place for air to be held before being pushed into the interior of the article of footwear.

In one aspect, the disclosure provides a ventilation system for an article of footwear. The ventilation system may include a sole layer having a forefoot region, a heel region disposed opposite the forefoot region, and a midfoot region disposed between the forefoot region and the heel region. The sole layer may have a first groove inlet disposed in the forefoot region, extending through an edge of the sole layer. The sole layer may also have a first groove on a top surface of the sole layer and extending from the first groove inlet and terminating in the forefoot region.

The edge may be a forward edge disposed in the forefoot region and the first inlet may be disposed on the forward edge. The sole layer may have a medial side, a lateral side disposed opposite medial side, and a longitudinal axis disposed between the medial side and the lateral side. The sole layer may have a medial edge along the medial side and a lateral edge along the lateral side. The first groove may have a first portion extending from the first inlet to a point disposed in the forefoot region. The first portion may be substantially parallel with the longitudinal axis. The first groove may have a second portion extending from the point disposed in the forefoot region to one of the lateral edge and the medial edge. The sole layer may have a second groove extending from a second groove inlet disposed in the forefoot region. The second groove inlet may extend through the edge of the sole layer. The second groove may be substantially parallel to the first groove. The second groove may be a mirror image of the first groove.

In one aspect, the disclosure provides a ventilation system for an article of footwear. The ventilation system may include a sole layer having a forefoot region, a heel region disposed opposite the forefoot region, and a midfoot region disposed between the forefoot region and the heel region. The sole layer may have a first groove inlet extending through an edge of the sole layer, a first groove formed in a top surface of the sole layer, a second groove formed in a top surface of the sole layer, and a first reservoir formed in the top surface of the sole layer. The first groove inlet may be disposed in the heel region and the first groove may extend from the first groove inlet and terminate at a first side of the first reservoir. The second groove may extend from a second side of the first reservoir that is opposite the first side of the first reservoir and terminates between the second side of the first reservoir and a forward edge of the sole layer.

The first groove inlet may be disposed through a rearward edge of the sole layer. The second groove may terminate in the forefoot region. The ventilation system may include a third groove formed in the top surface of the sole layer. The third groove may extend from a second groove inlet and terminate at the first side of the first reservoir. A fourth groove and a fifth groove may each be disposed in the top surface of the sole layer. The fourth groove and the fifth groove may each extend from the second side of the first reservoir and terminate between the second side of the first reservoir and the forward edge of the sole layer. The fourth groove may be a mirror image of the second groove. The ventilation system may further include a sockliner configured to be disposed over the sole layer. The sockliner may have at least one hole overlying the second groove. The first reservoir may be disposed in the midfoot region of the sole layer. The ventilation system may further include a second reservoir and a third groove each formed on the top surface of the sole layer. The third groove may extend from a second groove inlet disposed through a rearward edge of the sole layer to a first side of the second reservoir. The third groove may be substantially parallel to the first groove.

In one aspect, the disclosure provides a ventilation system for an article of footwear. The ventilation system may include a sole layer having a forefoot region, a heel region disposed opposite the forefoot region, and a midfoot region disposed between the forefoot region and the heel region. The sole layer may have a first groove inlet extending through an edge of the sole layer, a first groove, a second groove, and a first reservoir each formed in a top surface of the sole layer. The first groove may extend from the first groove inlet and terminate at a first side of the first reservoir. The first reservoir may be disposed in the forefoot region of the sole layer in a position that substantially aligns with a wearer's metatarsophalangeal joint. A second reservoir may be disposed in the forefoot region of the sole layer in a position that substantially aligns with a wearer's metatarsophalangeal joint. A second groove may connect the first reservoir to the second reservoir. The first reservoir may substantially align with a wearer's first and second metatarsophalangeal joints. The second reservoir may substantially align with a wearer's second and third metatarsophalangeal joints.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

A ventilation system for an article of footwear is disclosed. The ventilation system may be configured to direct air from outside the article of footwear to the inside of the article of footwear. The ventilation system may include a sole layer and a sockliner that work together to direct air from outside the article of footwear to the inside of the article of footwear. For example, FIGS. 1-9 illustrate an exemplary embodiment of a ventilation system 100 for an article of footwear. Ventilation system 100 may include a sole layer 102 and a sockliner 104 configured to lie on top of sole layer 102. Sockliner 104 may be contoured to correspond to a top surface of sole layer 102. Similarly, the bottom surface of the sockliner may be contoured to correspond to the top surface of the sole layer.

Figure 1:
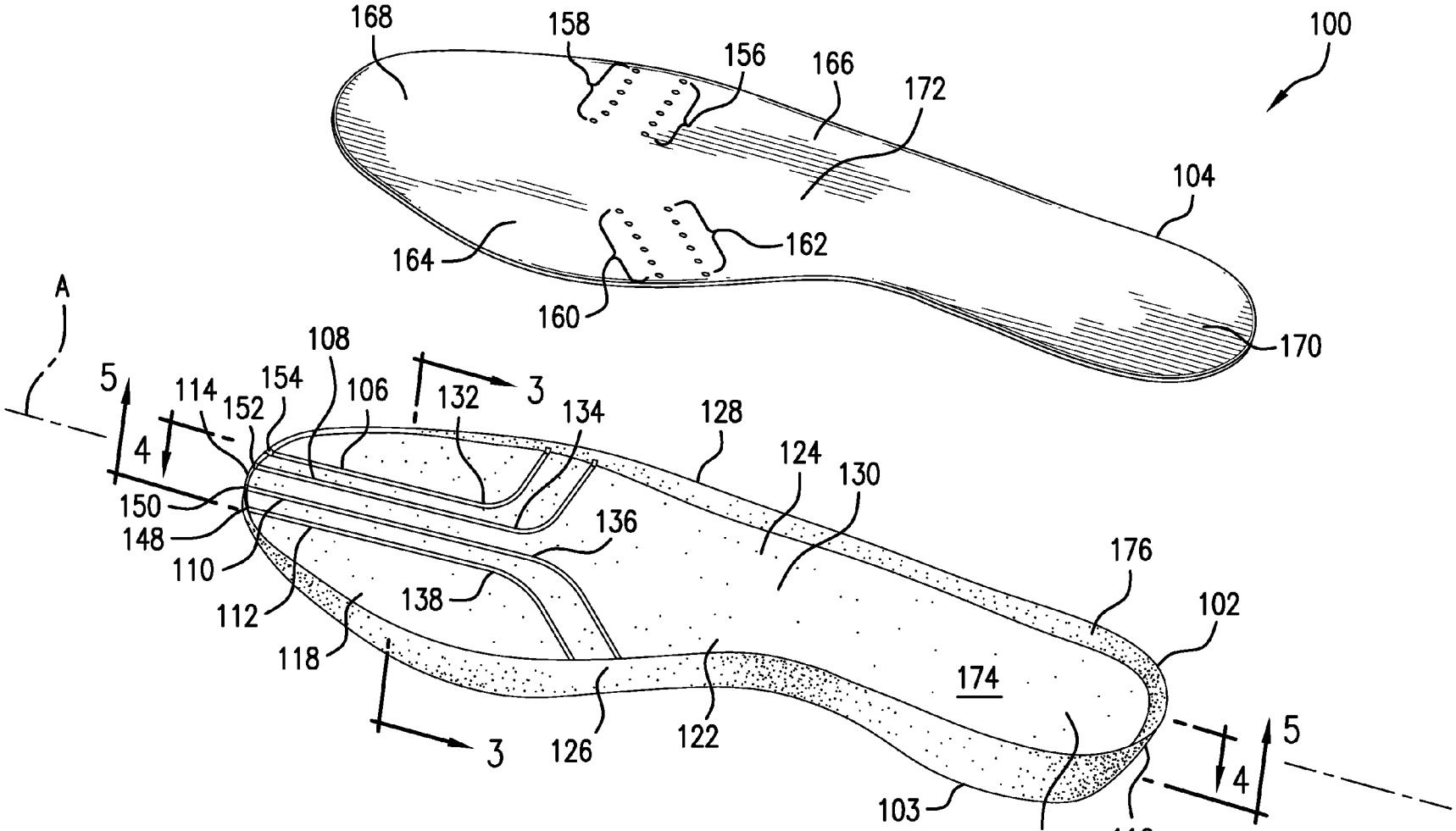
FIG. 1 is an exploded view of an exemplary embodiment of a ventilation system for an article of footwear, including a sole layer and a sockliner.
Figure 2:
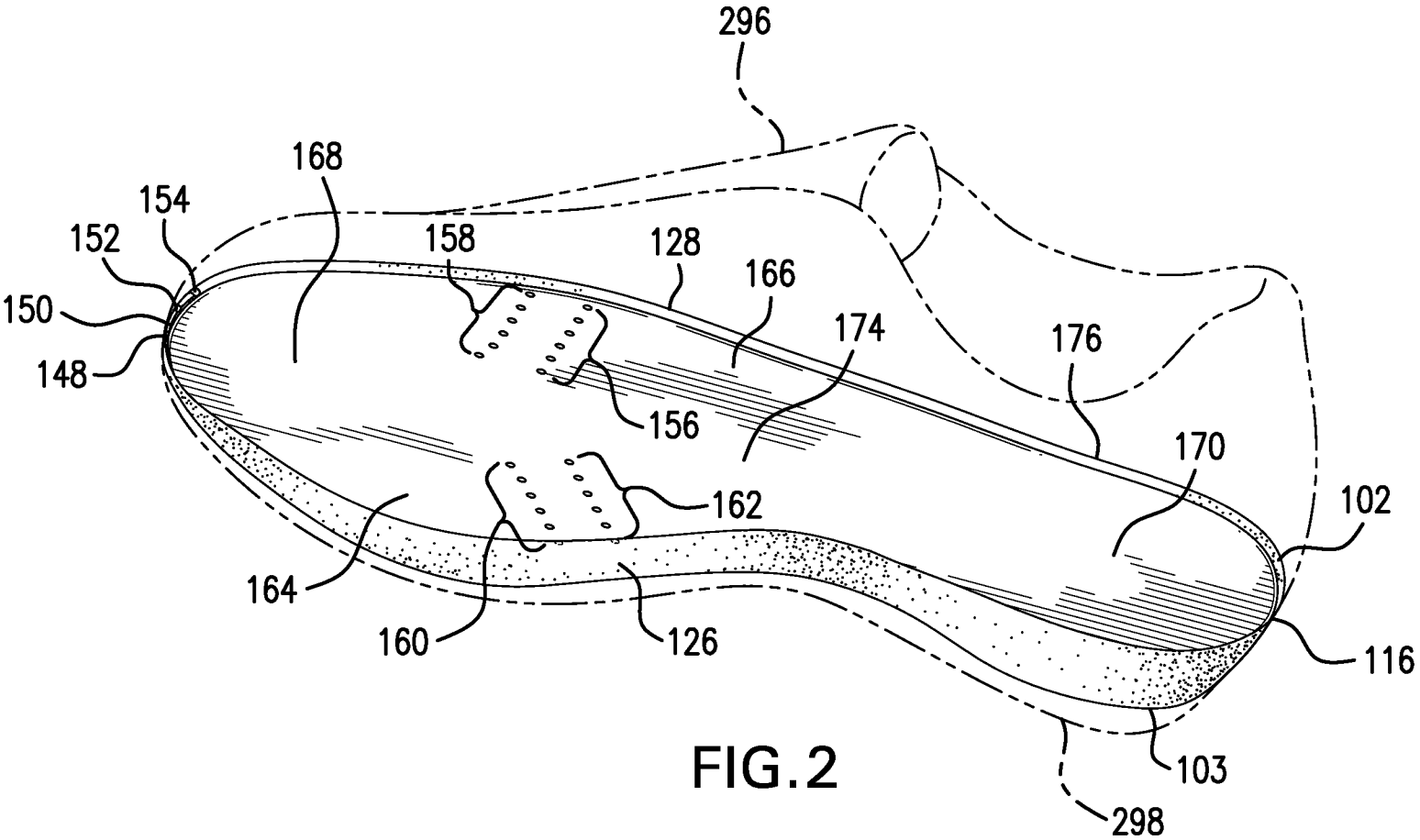
FIG. 2 is a view of the exemplary embodiment shown in FIG. 1 after assembly.

The sole layer may be any type of sole layer. For example, in some embodiments, as shown in FIGS. 1-9, sole layer 102 may be a midsole. FIG. 2 shows sole layer 102 and sockliner 104 assembled in an article of footwear having an upper 196 and an outsole 198. In embodiments with only a single sole layer, the sole layer may be the entire sole. In some embodiments, the sole layer may be an insole that is inserted inside the article of footwear above the sole.

The sockliner may be any type of sockliner configured to be disposed above a sole layer. The sockliner may provide cushioning and/or support to the wearer's foot.

The ventilation system may include one or more paths disposed between the top surface of the sole layer and a bottom surface of the sockliner. In some embodiments, the paths may comprise grooves formed within the top surface of the sole layer. For example, as shown in FIGS. 1-5, in some embodiments, sole layer 102 may include paths formed by a first groove 106, a second groove 108, a third groove 110, and a fourth groove 112. The grooves may have inlets disposed through an outer edge of the sole layer. For example, as shown in FIG. 1, first groove 106 may extend through a forward edge 114 of sole layer 102 such that a first groove inlet 154 is disposed on forward edge 114. By laying over the top surface of the sole layer and covering the grooves, the bottom of the sockliner may define a portion of the paths. In other words, the paths may be defined by the grooves in the sole layer and the portion of the sockliner covering the grooves. The sockliner may include openings overlying the grooves. For example, as shown in FIGS. 1, 2, 6, and 7, openings 158 may overlie first groove 106 such that air may enter first groove 106 through first groove inlet 154 and may exit first groove 106 through openings 158 into the interior of the article of footwear.

As discussed in more detail below, for example, with reference to FIGS. 6-9, the grooves being formed within the sole layer may provide a pumping mechanism during the normal course of providing cushioning for the user. The grooves may be compressed under a wearer's weight between the wearer's foot and the ground. When the wearer lifts his foot, the grooves may expand, drawing air in from outside of the article of footwear through inlets. When the wearer steps down, the grooves may be compressed causing air to be pushed into the interior of the article of footwear through openings in the sockliner.

The sole layer may include a forefoot region, a heel region disposed opposite forefoot region, and a midfoot region disposed between the forefoot region and the heel region. For example, as shown in FIGS. 1-9, sole layer 102 may include a forefoot region 118, a heel region 120 disposed opposite forefoot region 118, and a midfoot region 130 disposed between forefoot region 118 and heel region 120. The sole layer may include a medial side and a lateral side disposed opposite the medial side. For example, sole layer 102 may include a medial side 122 and a lateral side 124 disposed opposite medial side 122. A longitudinal axis A may extend through sole layer 102 between medial side 122 and lateral side 124. The sole layer may include edges disposed along the perimeter of the sole layer. For example, sole layer 102 may include a forward edge 114 in forefoot region 118 and a rearward edge 116 in heel region 120. Sole layer 102 may include a medial edge 126 along medial side 122 and a lateral edge 128 along lateral side 124. The sole layer may have a top surface and a bottom surface. For example, as shown in FIG. 1, sole layer 102 may have a top surface 174 and a bottom surface 103.

In some embodiments, the sole layer may have a lip disposed along a perimeter of the top surface. For example, as shown in FIG. 1, sole layer 102 may have a lip 176 disposed along the perimeter of top surface 174 of sole layer 102. The lip may provide a seal between the inside of the upper, the bottom surface of the sockliner, and the top of the sole layer to prevent air from escaping from around the sides of the sockliner into the shoe and to ensure that air enters the interior of the shoe from the openings in the sockliner. The sockliner and the sole layer may fit together such that the perimeter of the sockliner feels smooth and comfortable against the wearer's foot. In some embodiments, the height of the lip may have a consistent height around the perimeter of the sole layer. In some embodiments, the height of the lip may vary along the perimeter of the sole layer. For example, as shown in FIG. 1, lip 176 may have a greater height in heel region 120 than in forefoot region 118.

Figure 10:
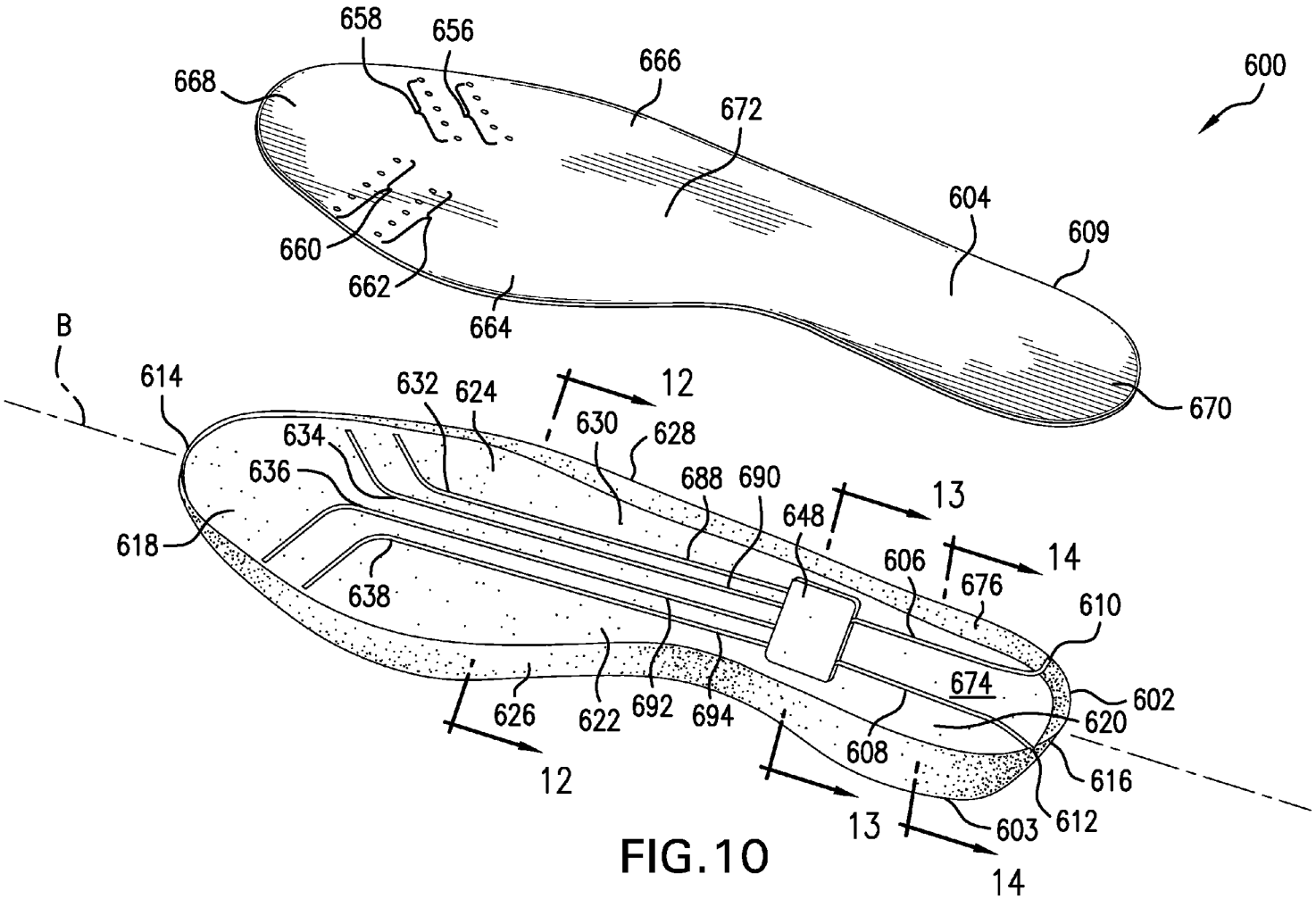
FIG. 10 is an exploded view of an exemplary embodiment of a ventilation system for an article of footwear, including a sole layer and a sockliner.

The grooves may be disposed in any region of the sole layer. In some embodiments, the grooves may be disposed along the forefoot region, midfoot region, and heel region. For example, FIG. 10 shows embodiments in which grooves may be disposed in along the forefoot region, midfoot region, and heel region. In some embodiments, the grooves may be disposed entirely in the midfoot and heel region. In some embodiments, the grooves may be disposed entirely in the heel region. In some embodiments, the grooves may be entirely disposed in the forefoot region. For example, referring back to FIG. 1, sole layer 102 may include paths formed by grooves disposed entirely in forefoot region 118. The location of the grooves may be selected based on a variety of factors. For example, the location of the grooves may be selected according to the activity the article of footwear is used for.

Figure 3:
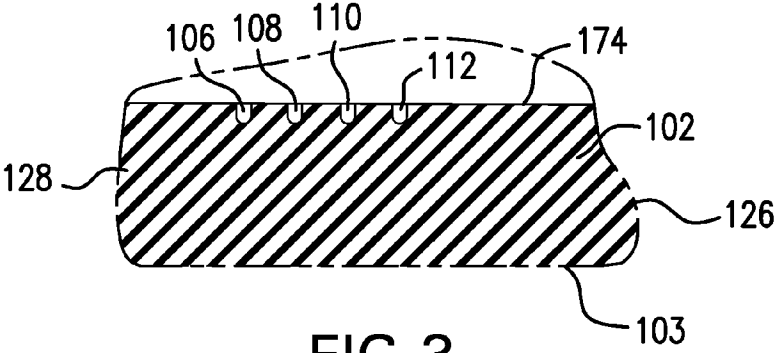
FIG. 3 is a cross-sectional view of the sole layer of the exemplary embodiment shown in FIG. 1, as defined by section line 3-3.
Figure 4:
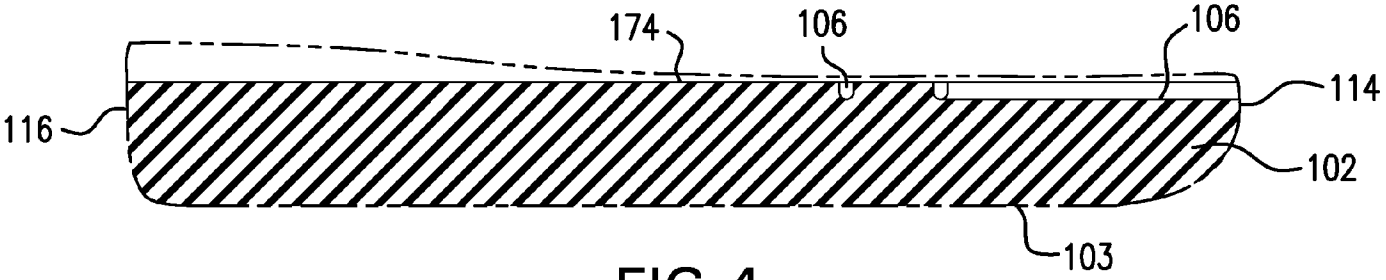
FIG. 4 is a cross-sectional view of the sole layer of the exemplary embodiment shown in FIG. 1, as defined by section line 4-4.
Figure 5:
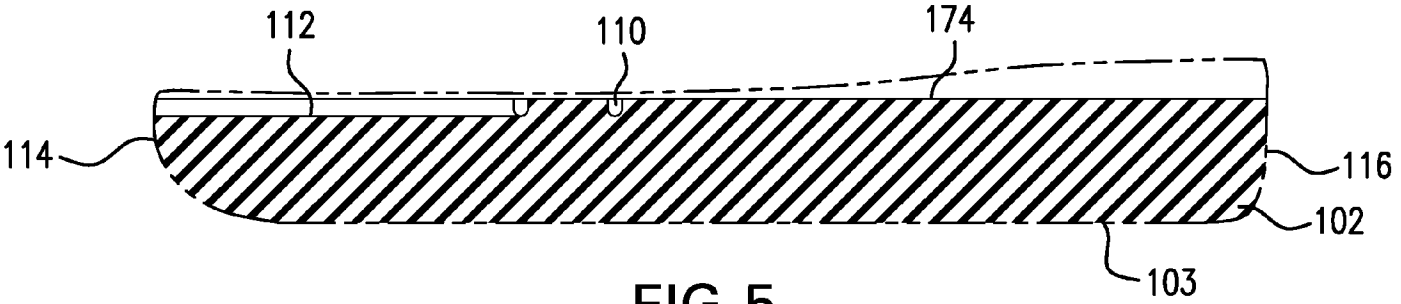
FIG. 5 is a cross-sectional view of the sole layer of the exemplary embodiment shown in FIG. 1, as defined by section line 5-5.
Figure 19:
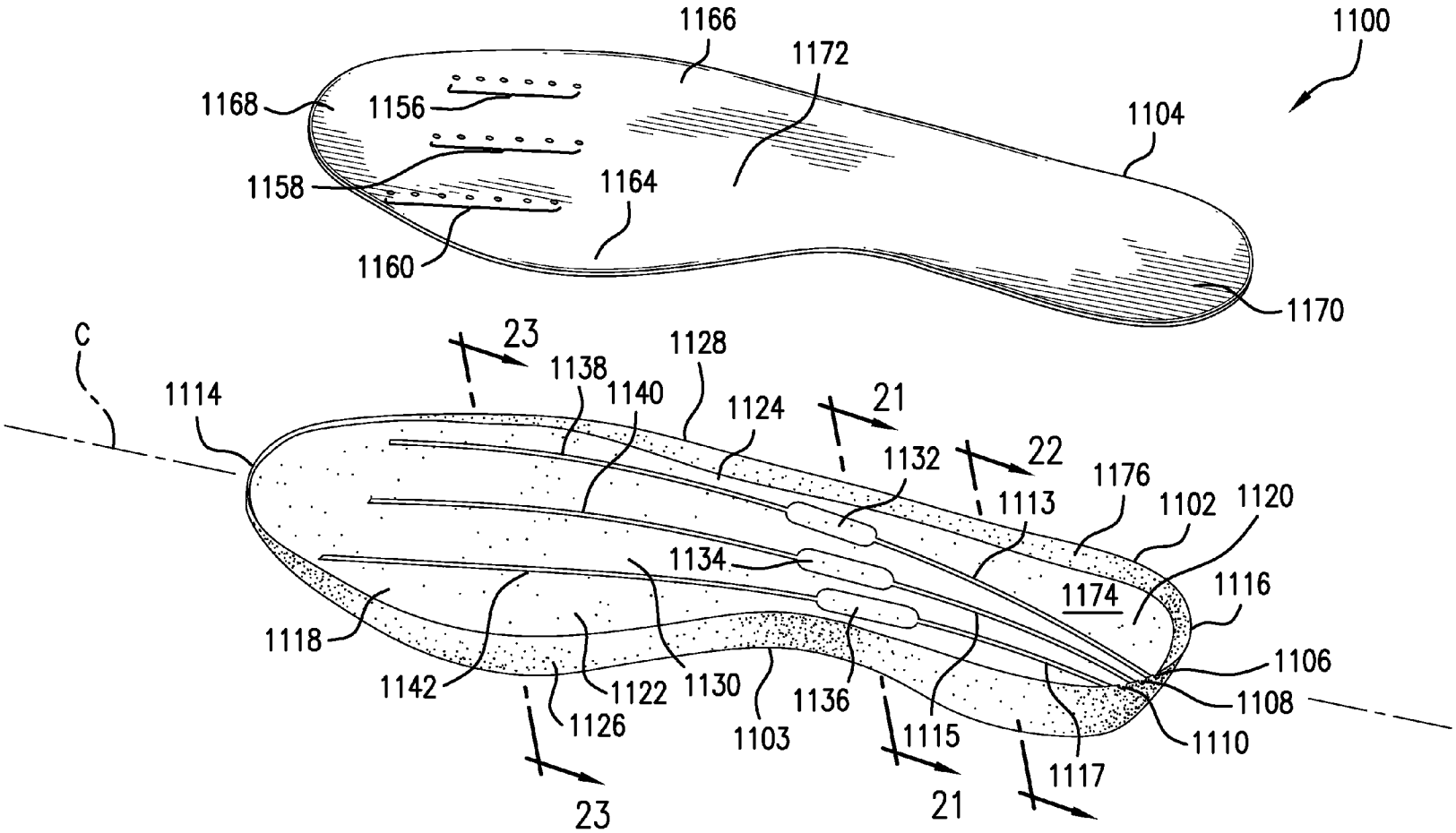
FIG. 19 is an exploded view of an exemplary embodiment of a ventilation system for an article of footwear, including a sole layer and a sockliner.

The grooves may provide paths having a variety of shapes and sizes. In some embodiments, the grooves may be straight and/or curved. For example, referring to FIG. 1, first groove 106 may extend straight from forward edge 114 to a point in the midfoot region and then curve and extend to an area adjacent lateral edge 128. In another example, FIG. 19 shows grooves that are slightly curved. The grooves are shown as being approximately the same size in the figures. However, the sizes of the grooves may vary. For example, in some embodiments, one groove may be deeper and/or wider than another. In another embodiment, each of the grooves may have a different depth and width. In some embodiments, as shown in FIGS. 3-5, the shape of the cross-section of the grooves may be substantially round. In other embodiments, the cross-section of the grooves may have a different shape. The sizes and shapes of the grooves may be selected based on a variety of factors. For example, the shapes of the grooves may be selected based on the location of the inlets and the outlets of the grooves and/or the pattern of compression experienced by the sole layer in response to a wearer's distribution of weight during a step. Similarly, the path of the grooves, including the inlet and point of termination, may be selected based on a variety of factors. For example, the point of termination may be selected based on the location in which the article of footwear is to be ventilated.

Figure 28:
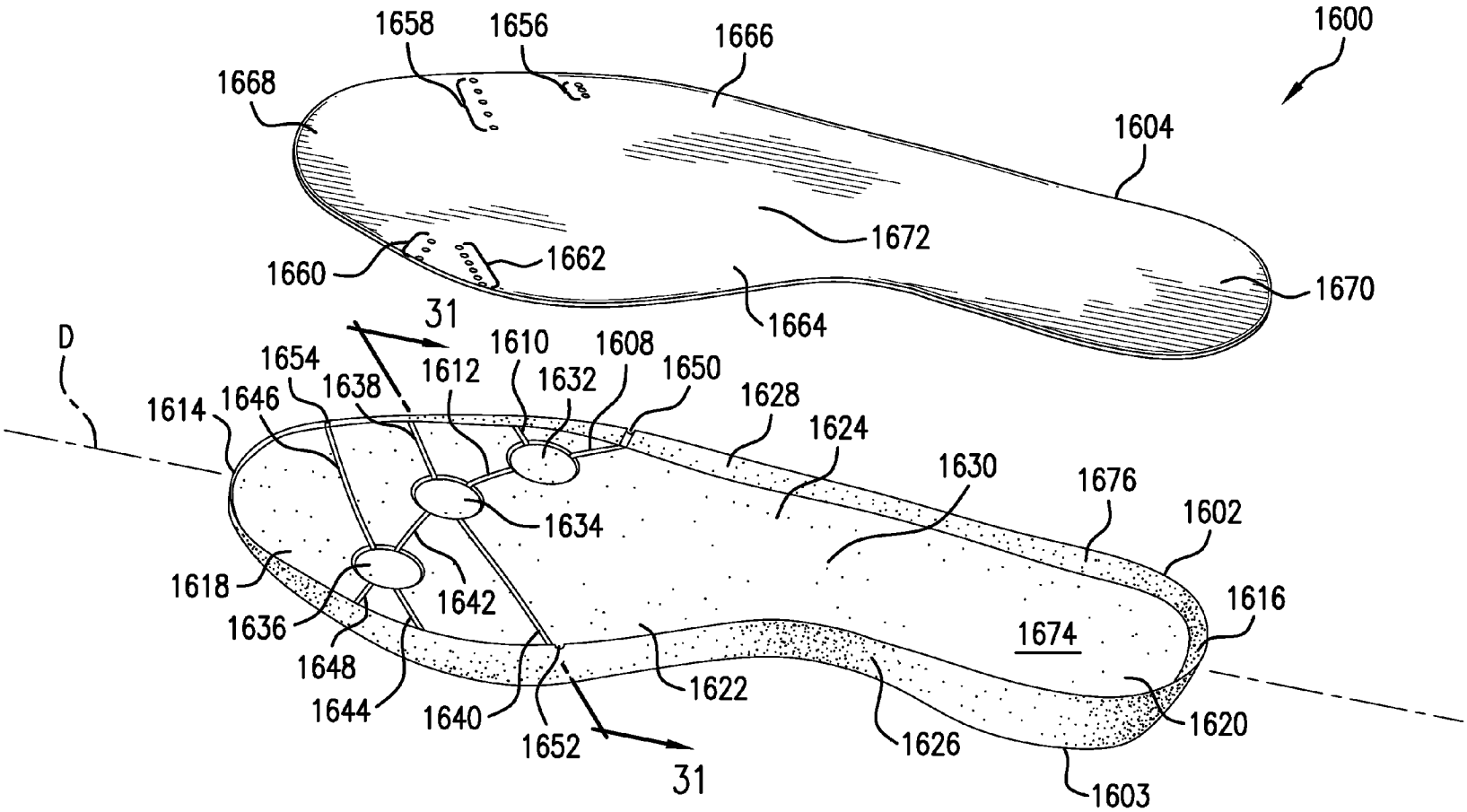
FIG. 28 is an exploded view of an exemplary embodiment of a ventilation system for an article of footwear, including a sole layer and a sockliner.

In some embodiments, one or more reservoirs may be connected to the grooves. For example, FIG. 28 shows a plurality of straight grooves and slightly curved grooves connected by reservoirs. Reservoirs may provide a larger area for the air to be stored until the air is pumped into the shoe. In some embodiments, as shown in FIG. 10, the reservoir(s) may be substantially rectangular. In some embodiments, the reservoir(s) may be sized and/or shaped differently. For example, as shown in FIG. 19, the reservoir(s) may be substantially oval. In another example, as shown in FIG. 28, the reservoir(s) may be substantially round. In some embodiments, the reservoirs may each have a different size and/or shape from one another. For example, one reservoir may be oval and another reservoir may be rectangular. While FIG. 10 shows one reservoir and FIGS. 19 and 28 show three reservoirs, the sole layer may include a different number of reservoirs. For example, the sole layer may include four reservoirs. In another example, the sole layer may include between four and ten reservoirs. While FIG. 10 shows a reservoir in the midfoot region of the sole layer, the reservoir may be positioned in another region of the sole layer. For example, as shown in FIG. 28, the reservoir(s) may be disposed in the forefoot region of the sole layer. The location, size, shape, and number of reservoirs may be selected based on a variety of factors. For example, the number of reservoirs may be selected based on the activity the shoe is worn for and/or the position of the grooves.

In some embodiments, check valves may be disposed at the inlets. In embodiments with reservoirs, check valves may be disposed at the intersection of grooves and reservoirs.

Figure 20:
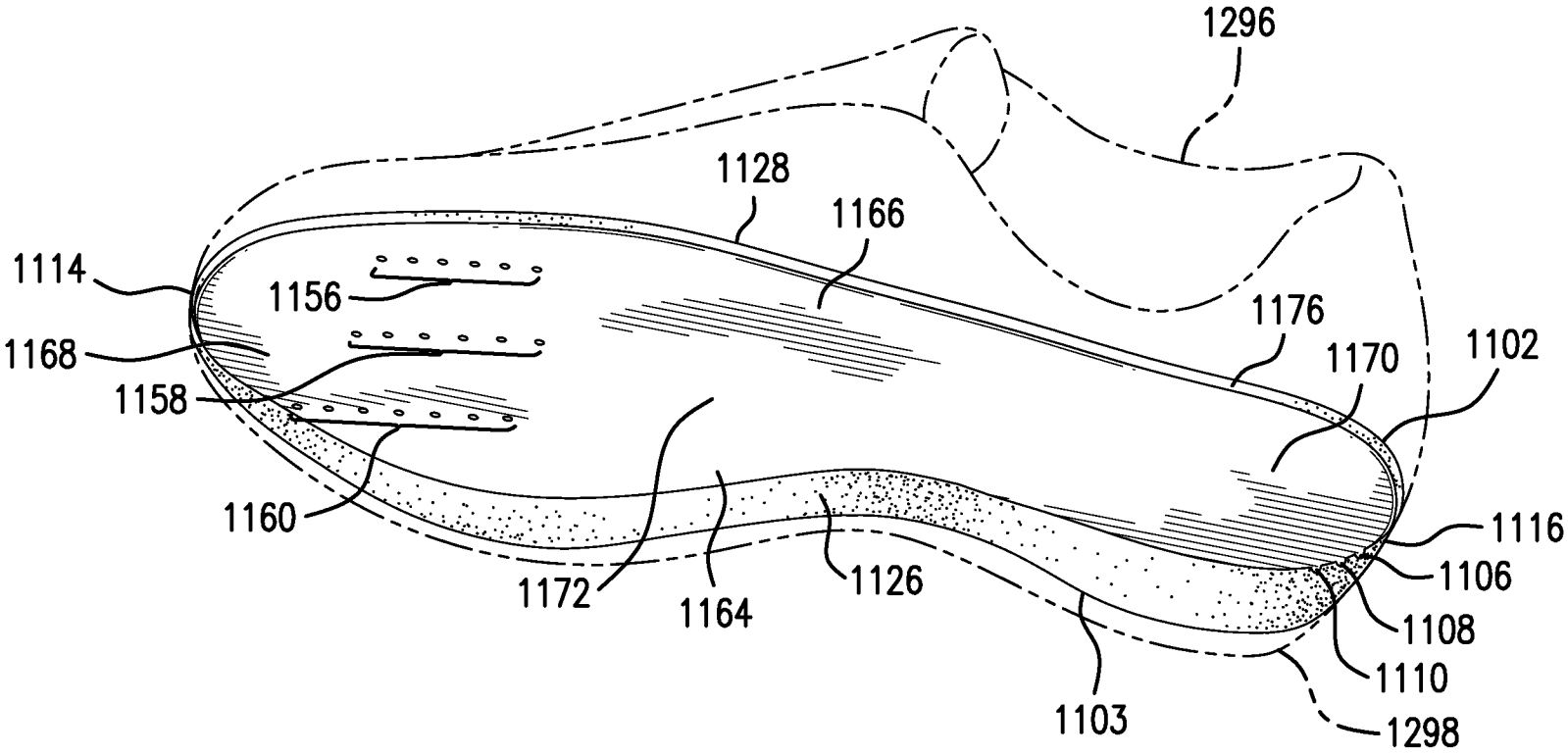
FIG. 20 is a view of the exemplary embodiment shown in FIG. 19 after assembly.
Figure 21:
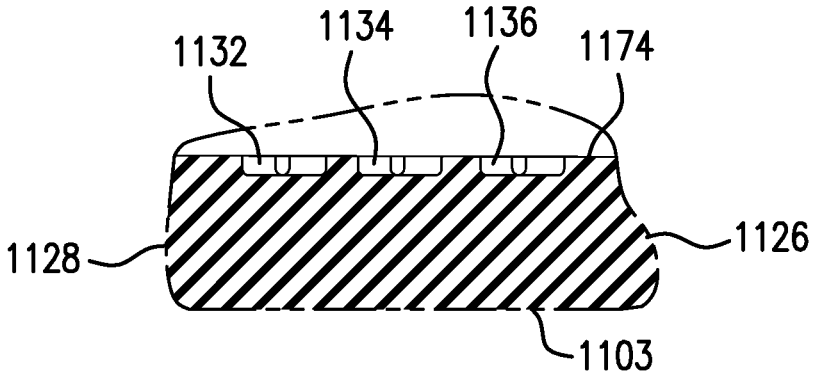
FIG. 21 is a cross-sectional view of the sole layer of the exemplary embodiment shown in FIG. 19, as defined by section line 21-21.
Figure 22:
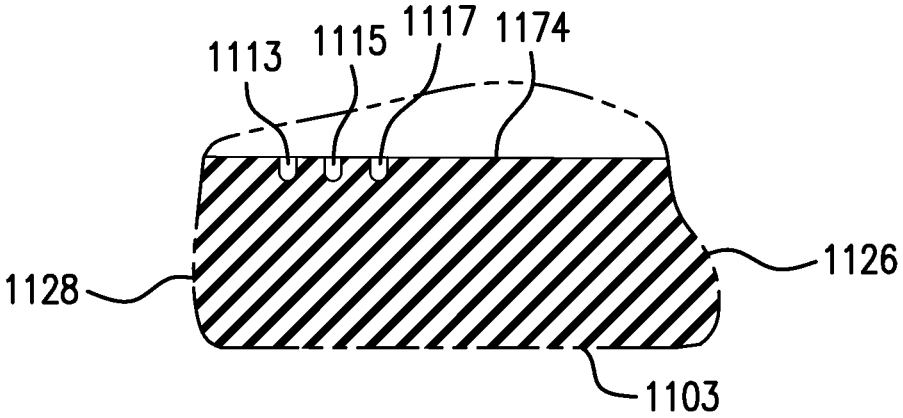
FIG. 22 is a cross-sectional view of the sole layer exemplary embodiment shown in FIG. 19, as defined by section line 22-22.
Figure 23:
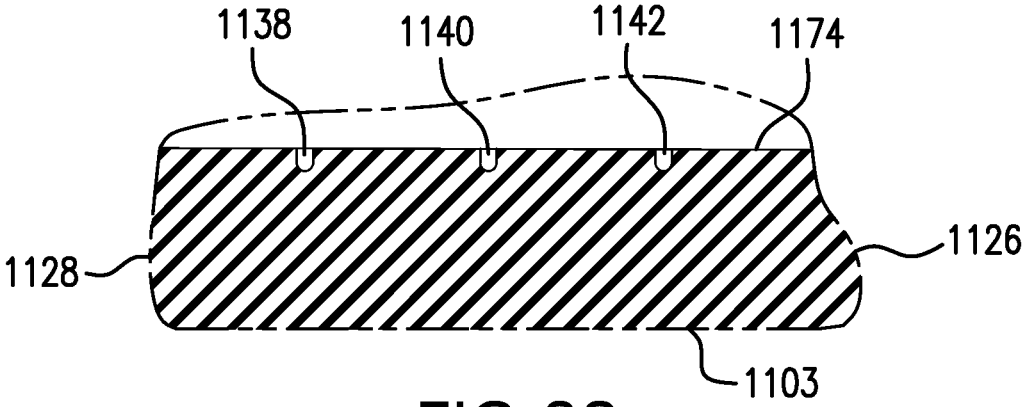
FIG. 23 is a cross-sectional view of the sole layer exemplary embodiment shown in FIG. 19, as defined by section line 23-23.

The number of grooves formed in the sole layer may vary. For example, as shown in FIG. 1, sole layer 102 may have four grooves. In another example, as shown in FIG. 20, sole layer 1102 may have three grooves. In other embodiments, the sole layer may have two grooves. In further embodiments, the sole layer may have between five and twenty grooves. The number of grooves may be selected based on a variety of factors. For example, the number of grooves may be selected based on the size and shape of the grooves.

The number of openings in the sockliner may vary. For example, FIGS. 1 and 2 show six openings per groove. In other embodiments, the sockliner may include from one to twenty openings per groove. The number of openings may be selected based on a variety of factors. For example, the number of openings may be selected based on the size of the groove, the size of the groove inlet, the size of the openings, and/or the material of the sockliner. The number of openings may be the same or different for each groove. In some embodiments, sole layer 102 may include openings that do not overlie grooves. In some embodiments, the openings may be the same size. In some embodiments, the openings may be sized differently.

The sole layer and sockliner may be made from any known material used for sole layers and sockliners in footwear. For example, the sole layer and/or sockliner may be made from a polymer, such as polyurethane or ethylene vinyl acetate. The type of material may be selected based on a variety of factors. For example, the type of material may be selected to provide a certain level of stability/support, cushioning to a wearer, and/or compressibility of the paths disposed between the sole layer and the sockliner.

As stated previously, FIGS. 1-9 show an embodiment in which the grooves are entirely disposed in the forefoot region. First groove 106 may extend from a first groove inlet 154 located at forward edge 114 to an area adjacent lateral edge 128. First groove inlet 154 may be configured to allow air to enter first groove 106. First groove inlet 154 may extend through forward edge 114. First groove 106 may have a first portion extending from first groove inlet 154 to a point 132 disposed in forefoot region 118. The first portion may be substantially parallel to longitudinal axis A. First groove 106 may have a second portion extending between point 132 and lateral edge 128. The second portion may curve from point 132 toward lateral edge 128 and extend in a direction angled with respect to longitudinal axis A. After first groove 106 curves toward lateral edge 128, first groove 106 may extend in a straight line that is angled with respect to longitudinal axis A and terminate at lateral edge 128.

Second groove 108 may extend from a second groove inlet 152 located at forward edge 114 to an area adjacent lateral edge 128. Second groove inlet 152 may be configured to allow air to enter second groove 108. Second groove inlet 152 may extend through forward edge 114. Second groove 108 may have a first portion extending from second groove inlet 152 to a point 134 disposed in forefoot region 118. The first portion may be substantially parallel to longitudinal axis A. Second groove 108 may have a second portion extending between point 134 and lateral edge 128. The second portion may curve from point 134 toward lateral edge 128 and extend in a direction angled with respect to longitudinal axis A. After second groove 108 curves toward lateral edge 128, second groove 108 may extend in a straight line that is angled with respect to longitudinal axis A and terminate at lateral edge 128.

Second groove 108 may be spaced from first groove 106. Second groove 108 may be substantially parallel to first groove 106. The first portion of first groove 106 may be spaced a first distance from the first portion of second groove 108. The second portion of first groove 106 may be spaced a second distance from second portion of second groove 108. The second distance may be larger than the first distance because the width of sole layer 102 is smaller than the length of sole layer 102. Thus, the grooves may have more room to be spaced apart along the length (parallel with longitudinal axis A) of sole layer 102 than along the width (perpendicular to longitudinal axis A) of sole layer 102. The spacing between first groove 106 and second groove 108 may be adjusted to change the path of the grooves and/or to change position of the inlet and/or outlet of the grooves.

Third groove 110 may extend from a third groove inlet 150 located at forward edge 114 to an area adjacent medial edge 126. Third groove 110 may be a mirror image of first groove 106. Third groove inlet 150 may be configured to allow air to enter third groove 110. Third groove inlet 150 may extend through forward edge 114. Third groove 110 may have a first portion extending from third groove inlet 150 to a point 136 disposed in forefoot region 118. The first portion may be substantially parallel to longitudinal axis A. Third groove 110 may have a second portion extending between point 136 and medial edge 126. The second portion may curve from point 136 toward medial edge 126 and extend in a direction angled with respect to longitudinal axis A. After third groove 110 curves toward medial edge 126, third groove 110 may extend in a straight line that is angled with respect to longitudinal axis A and terminate at medial edge 126.

Fourth groove 112 may extend from a fourth groove inlet 148 located at forward edge 114 to an area adjacent medial edge 126. Fourth groove 112 may be a mirror image of second groove 138. Fourth groove inlet 148 may be configured to allow air to enter fourth groove 112. Fourth groove inlet 148 may extend through forward edge 114. Fourth groove 112 may have a first portion extending from fourth groove inlet 148 to a point 138 disposed in forefoot region 118. The first portion may be substantially parallel to longitudinal axis A. Fourth groove 112 may have a second portion extending between point 138 and medial edge 126. The second portion may curve from point 138 toward medial edge 126 and extend in a direction angled with respect to longitudinal axis A. After fourth groove 112 curves toward medial edge 126, fourth groove 112 may extend in a straight line that is angled with respect to longitudinal axis A and terminate at medial edge 126.

Third groove 110 may be spaced from fourth groove 112. Third groove 110 may be substantially parallel to fourth groove 112. The first portion of third groove 110 may be spaced a first distance from the first portion of fourth groove 112. The second portion of third groove 110 may be spaced a second distance from second portion of fourth groove 112. Similar to the distances between first groove 106 and second groove 108 (as discussed above), the second distance between third groove 110 and fourth groove 112 may be larger than the first distance between third groove 110 and fourth groove 112 because the width of sole layer 102 is smaller than the length of sole layer 102.

Sockliner 104 may include a forefoot region 168, a heel region 170 opposite forefoot region 168, and midfoot region 172 between forefoot region 168 and heel region 170. Sockliner 104 may include a medial side 164 and a lateral side 166 disposed opposite medial side 164. In some embodiments, sockliner 104 may have a lip corresponding to lip 176 of sole layer 102. Sockliner 104 may include one or more openings through which air may be introduced into the interior of the article of footwear. In some embodiments, sockliner 104 may include one or more openings overlying the grooves. For example, as shown in FIGS. 1 and 2, openings 158 and openings 156 may be disposed in forefoot region 168 on the lateral side of sockliner 104. Openings 158 may overlie first groove 106 such that air may enter first groove 106 through first groove inlet 154 and may exit first groove 106 through openings 158 into the interior of the article of footwear. Openings 156 may overlie second groove 108 such that air may enter second groove 108 through second groove inlet 152 and may exit second groove 108 through openings 156 into the interior of the article of footwear.

Openings 160 and openings 162 may be disposed in forefoot region 168 on the medial side of sockliner. Openings 162 may overlie third groove 110 such that air may enter through third groove inlet 150 and may exit third groove 110 through openings 162 into the interior of the article of footwear. Openings 160 may overlie fourth groove 112 such that air may enter fourth groove 106 through fourth groove inlet 148 and may exit fourth groove 112 through openings 160 into the interior of the article of footwear.

Figure 7:
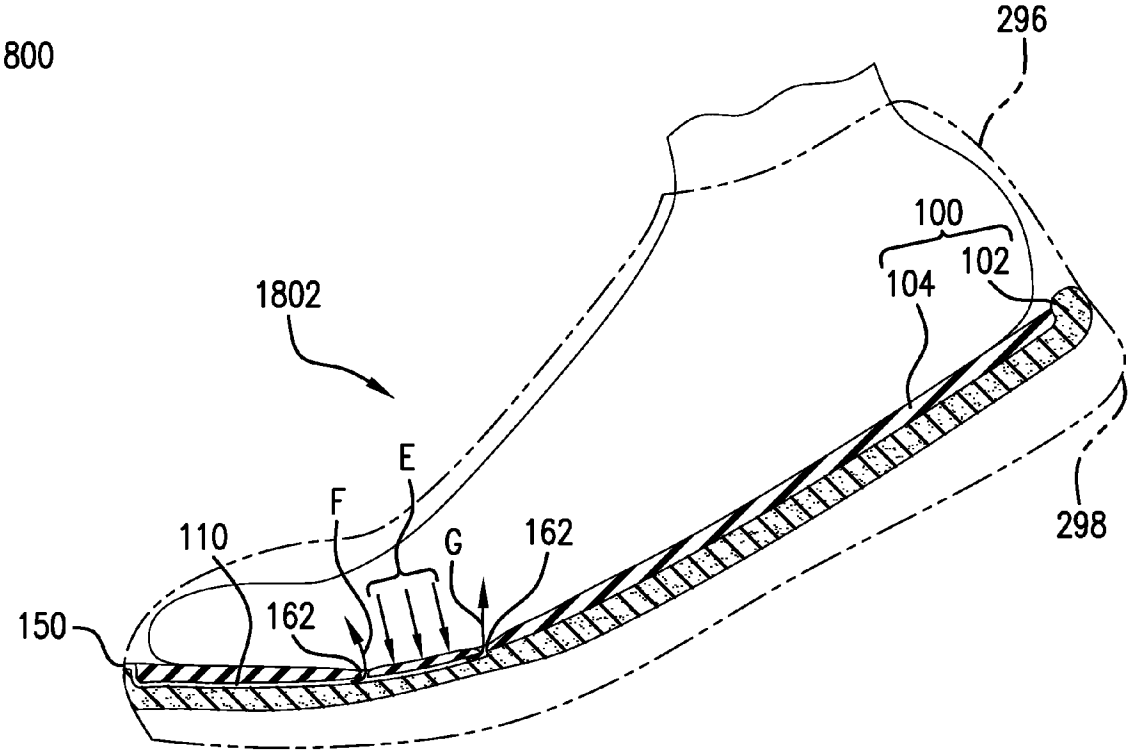
FIG. 7 is a detailed view of the article of footwear shown in FIG. 6.
Figure 6:
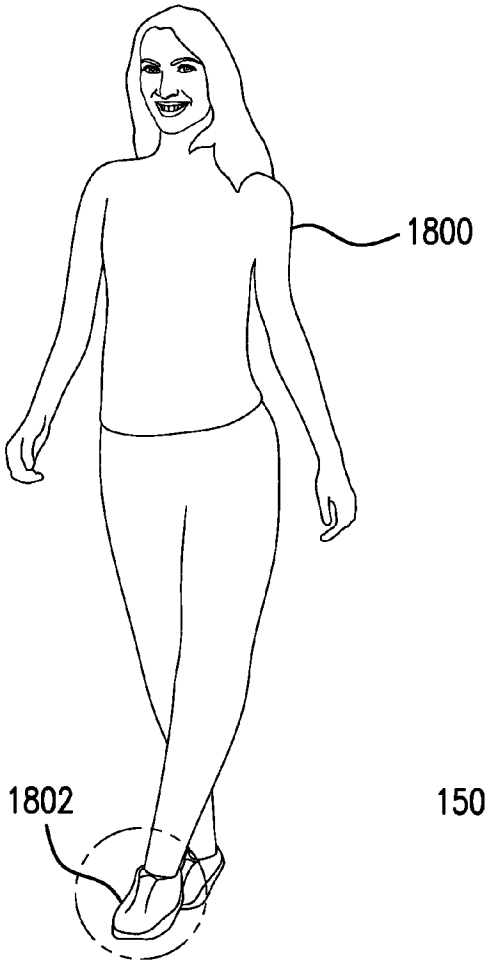
FIG. 6 is a person stepping down while wearing an article of footwear incorporating an exemplary embodiment of a ventilation system.

FIGS. 6-9 display ventilation system 100 in action. In FIGS. 6-9, a wearer 1800 is wearing an article of footwear 1802 incorporating ventilation system 100. For simplicity, only third groove 150 and two of outlets 162 are shown, but it is understood that any of the paths and outlets may behave as shown in FIGS. 6-9. FIGS. 6-7 show wearer 1800 taking a step forward with her left foot. As wearer 1800 steps forward, her weight shifts to forefoot region 118, as indicated by arrows E. The pressure of the wearer's weight may cause the portion of sole layer 102 underlying the wearer's weight to compress. In some embodiments, the pressure of the wearer's weight may cause the portion of sockliner 104 underlying the wearer's weight to compress. While the drawings show sole layer 102 and sockliner 104 compressing near the arrows E, it is understood that sole layer 102 and/or sockliner 104 may compress at any other location experiencing pressure. The amount of compression may vary with the amount of pressure experienced by sole layer 102 and/or sockliner 104, as well as with the type of material used to make sole layer 102 and/or sockliner 104. As sole layer 102 and/or sockliner 104 compress, the paths disposed between sole layer 102 and sockliner 104 may decrease in volume, expelling air (indicated by arrows F and G) from the paths through openings 156, openings 158, openings 160, and openings 162 into the interior of article of footwear 1802.

Figure 9:
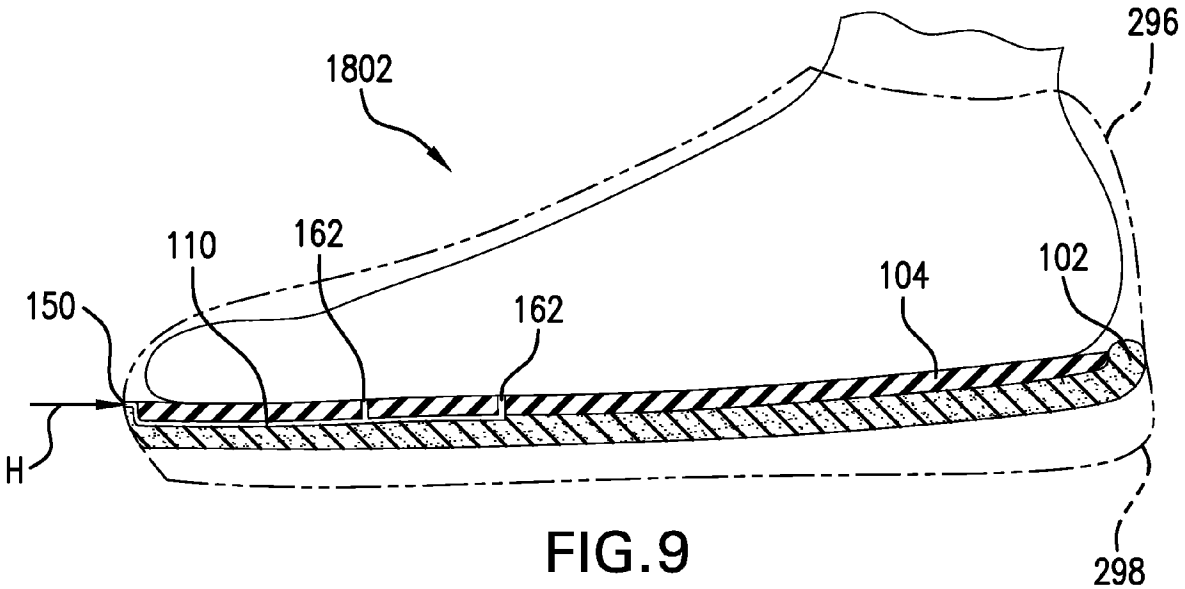
FIG. 9 is a detailed view of the article of footwear shown in FIG. 8.
Figure 8:
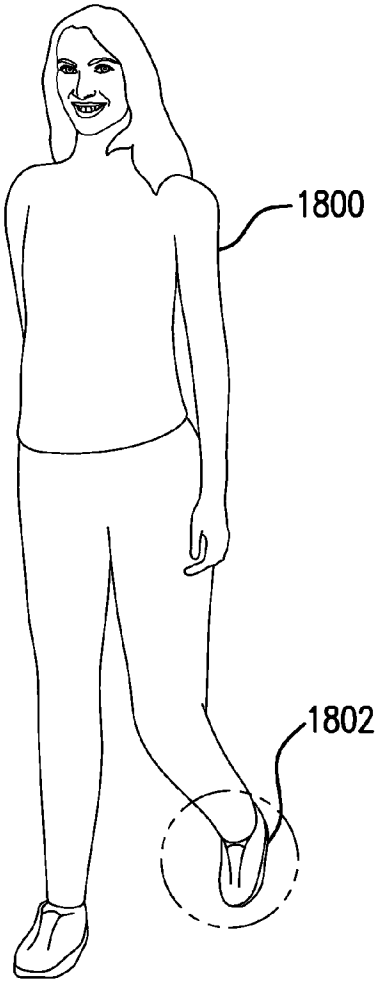
FIG. 8 is the person of FIG. 6 lifting a foot while wearing an article of footwear incorporating an exemplary embodiment of a ventilation system.

FIGS. 8-9 show wearer 1800 immediately after taking a step forward with her left foot such that her left foot is now in the air. In this position, the wearer's weight no longer compresses sole layer 102 and/or sockliner 104. The resilience of the material of sole layer 102 and/or sockliner 104 may cause sole layer 102 and/or sockliner 104 to return to the uncompressed state, causing the paths to expand, drawing air into the paths through the groove inlets (indicated by arrow H).

Figure 11:
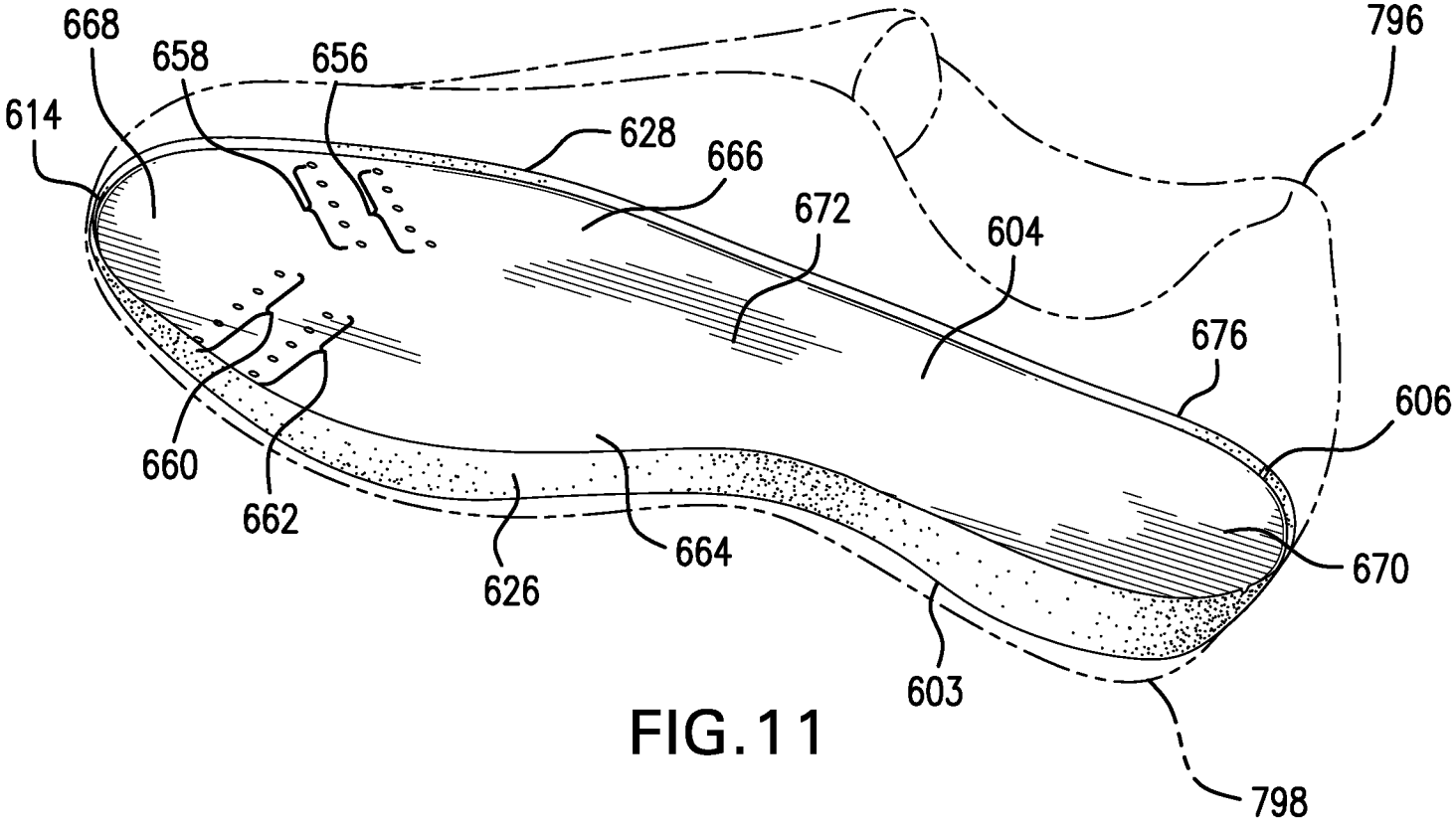
FIG. 11 is a view of the exemplary embodiment shown in FIG. 10 after assembly.
Figure 12:
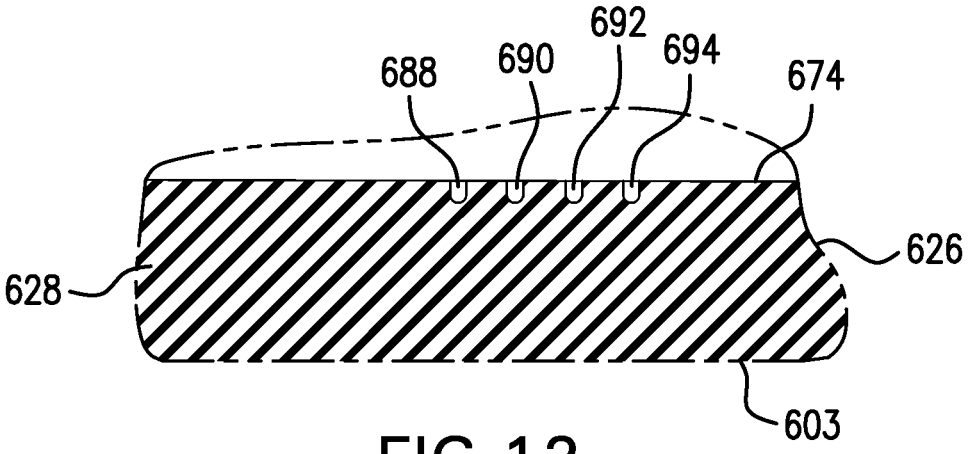
FIG. 12 is a cross-sectional view of the sole layer of the exemplary embodiment shown in FIG. 10, as defined by section line 12-12.
Figure 13:
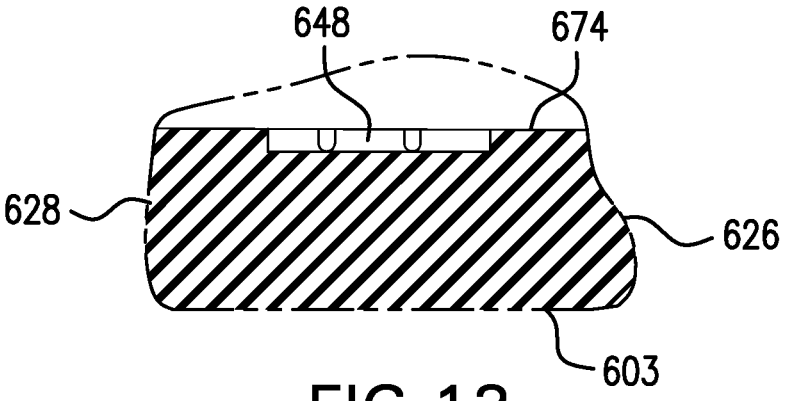
FIG. 13 is a cross-sectional view of the sole layer of the exemplary embodiment shown in FIG. 10, as defined by section line 13-13.
Figure 14:
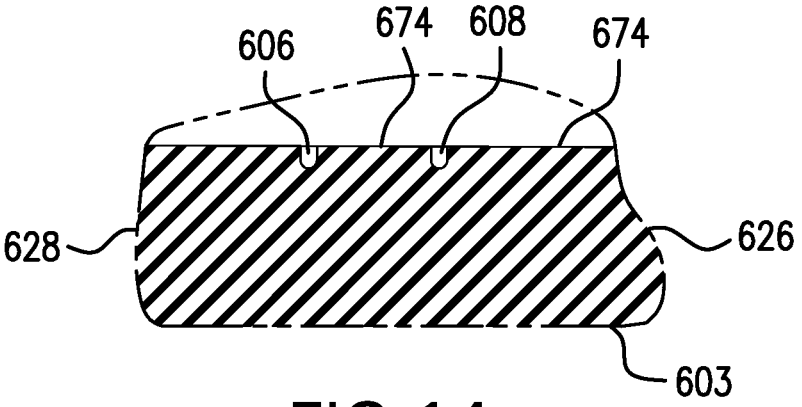
FIG. 14 is a cross-sectional view of the sole layer of the exemplary embodiment shown in FIG. 10, as defined by section line 14-14.

FIGS. 10-18 illustrate an exemplary embodiment of a ventilation system 600 for an article of footwear. As shown in FIGS. 10-11, ventilation system 600 may include a sole layer 602 and a sockliner 604 configured to lie on top of sole layer 602. As discussed in more detail below, sole layer 602 may include a reservoir and a plurality of grooves.

As previously stated, the sole layer may be any type of sole layer. FIG. 11 shows sole layer 602 and sockliner 604 assembled in an article of footwear having an upper 796 and an outsole 798.

Sole layer 602 may include a forefoot region 618, a heel region 620 disposed opposite forefoot region 618, and a midfoot region 630 disposed between forefoot region 618 and heel region 620. Sole layer 602 may include edges disposed about the perimeter of sole layer 602. Sole layer 602 may include a forward edge 614 in forefoot region 618 and a rearward edge 616 in heel region 620. Sole layer 602 may include a medial side 622 and a lateral side 624 disposed opposite medial side 622. A longitudinal axis B may extend through sole layer 602 between medial side 622 and lateral side 624. Sole layer 602 may include a medial edge 626 along medial side 622 and a lateral edge 628 along lateral side 624.

In some embodiments, sole layer 602 may have a lip 676 disposed along the perimeter of sole layer 602. The height of lip 676 may vary along the perimeter of sole layer 602. For example, as shown in FIG. 10, lip 676 may have a greater height in heel region 620 than in forefoot region 618. Sole layer 602 may have a top surface 674 and a bottom surface 603.

Sole layer 602 may include paths formed by grooves. For example, sole layer 602 may include paths formed by a first groove 606, a second groove 608, a third groove 688, a fourth groove 690, a fifth groove 692, and a sixth groove 694. In some embodiments, two or more grooves may be connected to one another by a reservoir. For example, first groove 606 and second groove 608 may be connected to third groove 688, fourth groove 690, fifth groove 692, and sixth groove 694 by a reservoir 648. The reservoir may have a first side closer to rearward edge 616 than forward edge 614 and a second side disposed opposite the first side. One or more grooves may be disposed between an inlet and the first side. For example, first groove 606 and second groove 608 may both be disposed between an inlet and the first side of reservoir 648.

One or more grooves may extend from the second side of reservoir 648 and terminate at a point between the second side of reservoir 648 and forward edge 614. For example, third groove 688, fourth groove 690, fifth groove 692, and sixth groove 694 may extend from the second side of reservoir 648 and terminate at a point between the second side of reservoir 648 and forward edge 614.

First groove 606 may extend between a first groove inlet 610, disposed at rearward edge 616, and reservoir 648. First groove inlet 610 may be configured to allow air to enter first groove 606. First groove inlet 610 may extend through rearward edge 616. Second groove 608 may extend between a second groove inlet 612, disposed at rearward edge 616, and reservoir 648. Second groove inlet 612 may be configured to allow air to enter second groove 608. Second groove inlet 610 may extend through rearward edge 616. First groove 606 and second groove 608 may both be substantially parallel with longitudinal axis B. FIG. 10 shows two grooves disposed between a reservoir and inlets located at an edge of a sole layer. However, in some embodiments, a single groove may replace first groove 606 and second groove 608. In other embodiments, three to ten grooves may be disposed between a reservoir and inlets located at an edge of a sole layer. As previously stated, the size, shape, and number of grooves may be selected based on a variety of factors.

In some embodiments, as shown in FIG. 10, reservoir 648 may be disposed in midfoot region 630. In other embodiments, reservoir 648 may be disposed in forefoot region 618 or heel region 620. Reservoir 648 may be disposed in midfoot region 630 adjacent heel region 620. Such a placement may allow the grooves disposed in heel region 620 to be compressed before compressing reservoir 648 when a wearer takes a step forward. Compressing the grooves disposed in heel region 620 before compressing reservoir 648 may close off the connection between the reservoir and the inlets such that air may be forced into the grooves disposed between the reservoir and the forward edge.

Third groove 688 may extend from reservoir 648 to an area in forefoot region 618 that is adjacent to lateral edge 628.

Third groove 688 may have a first portion extending from reservoir 648 to a point 632 disposed in forefoot region 618. The first portion may be substantially parallel to longitudinal axis B. Third groove 688 may have a second portion extending between point 632 and lateral edge 628. The second portion may curve from point 632 toward lateral edge 628.

Fourth groove 690 may extend from reservoir 648 to an area in forefoot region 618 that is adjacent to lateral edge 628. Fourth groove 690 may have a first portion extending from reservoir 648 to a point 634 disposed in forefoot region 618. The first portion may be substantially parallel to longitudinal axis B. Fourth groove 690 may have a second portion extending between point 634 and lateral edge 628. The second portion may curve from point 634 toward lateral edge 628.

Fifth groove 692 may be a mirror image of fourth groove 690. Fifth groove 692 may extend from reservoir 648 to an area in forefoot region 618 that is adjacent to medial edge 626. Fifth groove 692 may have a first portion extending from reservoir 648 to a point 636 disposed in forefoot region 618. The first portion may be substantially parallel to longitudinal axis B. Fifth groove 692 may have a second portion extending between point 636 and medial edge 626. The second portion may curve from point 636 toward medial edge 624.

Sixth groove 694 may be a mirror image of third groove 688. Sixth groove 694 may extend from reservoir 648 to an area in forefoot region 618 that is adjacent to medial edge 626. Sixth groove 694 may have a first portion extending from reservoir 648 to a point 638 disposed in forefoot region 618. The first portion may be substantially parallel to longitudinal axis B. Sixth groove 694 may have a second portion extending between point 638 and medial edge 626. The second portion may curve from point 638 toward medial edge 624.

FIG. 10 shows four grooves disposed between a reservoir and forward edge 614. However, in some embodiments, one to three grooves may replace third groove 688, fourth groove 690, fifth groove 692, and sixth groove 694. In other embodiments, five to fifteen grooves may be disposed between a reservoir and forward edge 614. The size, shape, and number of grooves may be selected based on a variety of factors. For example, the number of grooves may be selected based on the size and shape of the reservoir.

In some embodiments, one or more of third groove 688, fourth groove 690, fifth groove 692, and sixth groove 694 may terminate in midfoot region 630 instead of forefoot region 618. The path of these grooves may also extend in different directions from those shown in FIG. 10. The path of the grooves, including the location of termination, may be selected based on a variety of factors. For example, the path of the grooves may be selected based on the places in which air is to enter the article of footwear.

Sockliner 604 may include a forefoot region 668, a heel region 670 opposite forefoot region 668, and a midfoot region 672 between forefoot region 668 and heel region 670. Sockliner 604 may include a medial side 664 and a lateral side 666 disposed opposite medial side 664. In some embodiments, sockliner 604 may have a lip corresponding to lip 676 of sole layer 602. Sockliner 604 may include one or more openings through which air may be introduced into the interior of the article of footwear. In some embodiments, sockliner 604 may include one or more openings overlying the grooves. For example, as shown in FIGS. 10 and 11, openings 656 and openings 658 may be disposed in forefoot region 668 on a lateral side 666 of sockliner 604. Openings 656 may overlie third groove 688 such that air may enter third groove 688 from reservoir 648 and may exit third groove 688 through openings 656 into the interior of the article of footwear. Openings 658 may overlie fourth groove 690 such that air may enter fourth groove 690 from reservoir 648 and may exit fourth groove 690 through openings 658 into the interior of the article of footwear.

Openings 660 and openings 662 may be disposed in forefoot region 668 on the medial side of sockliner. Openings 660 may overlie fifth groove 692 such that air may enter from reservoir 648 and may exit fifth groove 692 through openings 660 into the interior of the article of footwear. Openings 662 may overlie sixth groove 694 such that air may enter from reservoir 648 and may exit sixth groove 694 through openings 662 into the interior of the article of footwear.

While FIGS. 10 and 11 show five openings per groove, sockliner 604 may include any number of openings per groove. For example, sockliner 604 may include from one to fifteen openings per groove. The number of openings may be selected based on a variety of factors. For example, the number of openings may be selected based on the size of the groove, the size of the groove inlet, and/or the material of the sockliner. The number of openings may be the same or different for each groove. In some embodiments, sole layer 602 may include openings that do not overlie grooves.

Figure 16:
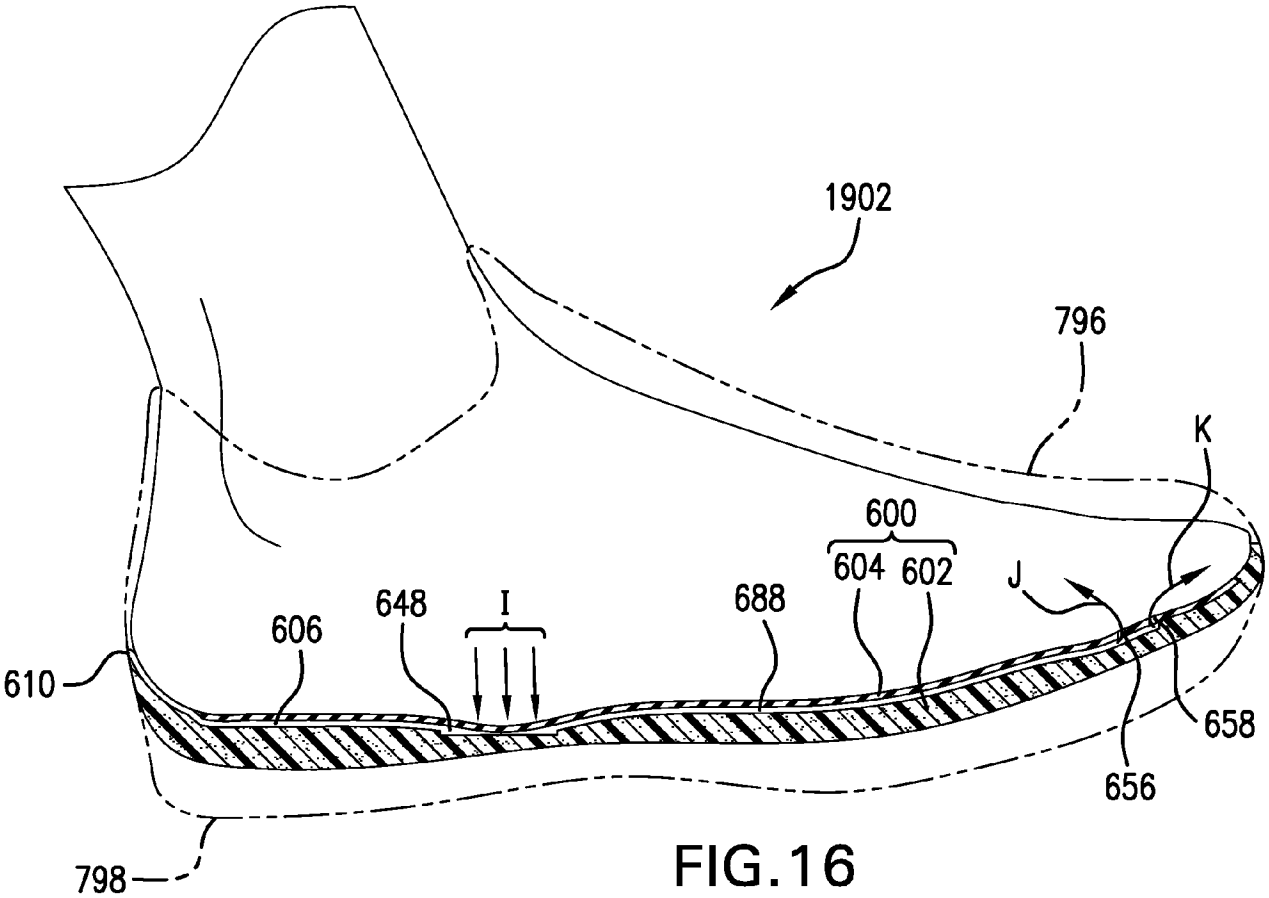
FIG. 16 is a detailed view of the article of footwear shown in FIG. 15.
Figure 15:
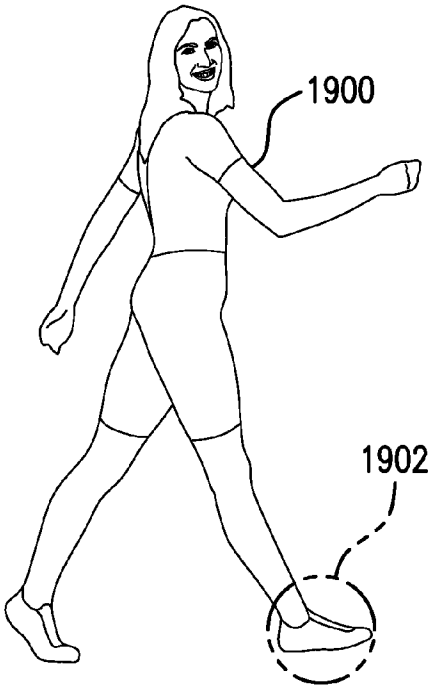
FIG. 15 is a person stepping down while wearing an article of footwear incorporating an exemplary embodiment of a ventilation system.

FIGS. 15-18 display ventilation system 600 in action. In FIGS. 15-18, a wearer 1900 is wearing an article of footwear incorporating ventilation system 600. For simplicity, first groove 606, third groove 688, openings 656, reservoir 648, and openings 658 are shown, but it is understood that any of the paths and outlets may behave as shown in FIGS. 15-18. FIGS. 15-16 show wearer 1900 taking a step forward with her right foot. As wearer 1900 steps forward, her weight shifts to midfoot region 630, as indicated by arrows I. The pressure of the wearer's weight may cause the portion of sole layer 602 underlying the wearer's weight to compress midfoot region 630 adjacent heel region 620. In some embodiments, the pressure of the wearer's weight may cause the portion of sockliner 604 underlying the wearer's weight to compress. While the drawings show sole layer 602 and sockliner 604 compressing near the arrows I, it is understood that sole layer 602 and/or sockliner 604 may compress at any other location experiencing pressure. The amount of compression may vary with the amount of pressure experienced by sole layer 602 and/or sockliner 604, as well as with the type of material used to make sole layer 602 and/or sockliner 604. As sole layer 602 and/or sockliner 604 compress, the paths disposed between sole layer 602 and sockliner 604 and the space between reservoir 648 and sockliner 604 may decrease in volume, expelling air (indicated by arrows J and K) from the paths through openings 656 and openings 658 into the interior of article of footwear 1902.

Figure 18:
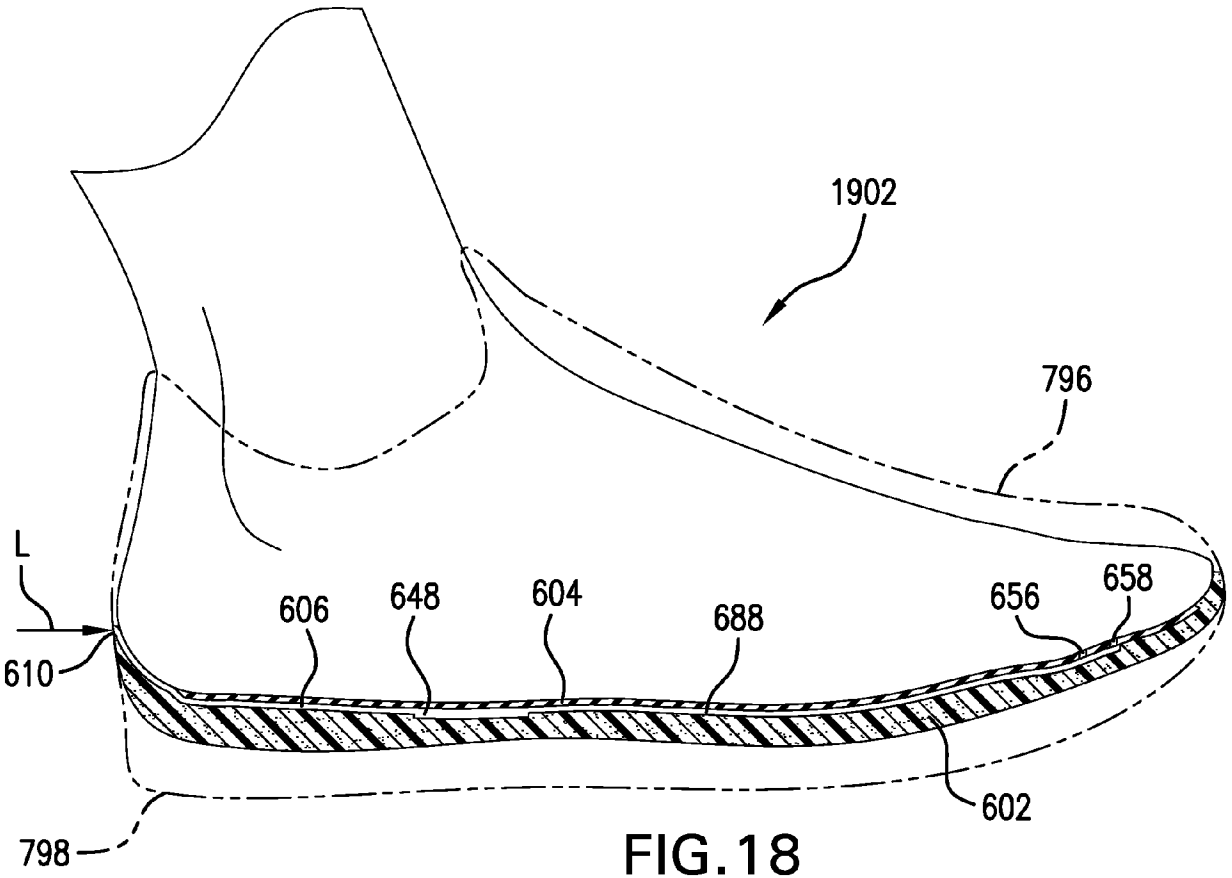
FIG. 18 is a detailed view of the article of footwear shown in FIG. 17.
Figure 17:
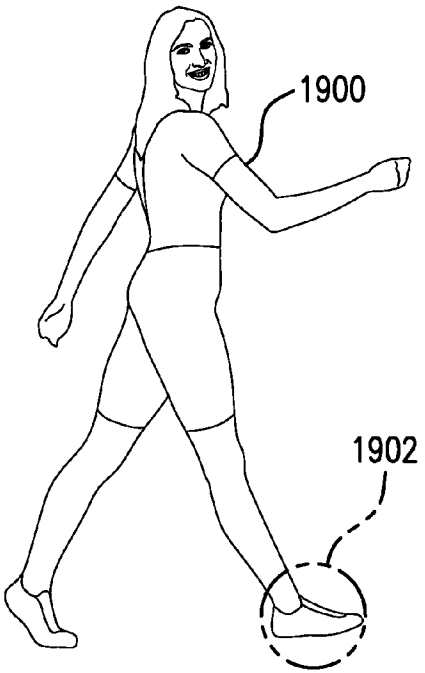
FIG. 17 is the person of FIG. 15 lifting a foot while wearing an article of footwear incorporating an exemplary embodiment of a ventilation system.

FIGS. 17-18 show wearer 1900 immediately after taking a step forward with her right foot such that her right foot is now in the air. In this position, the wearer's weight no longer compresses sole layer 602 and/or sockliner 604. The resilience of the material of sole layer 602 and/or sockliner 604 may cause sole layer 602 and/or sockliner 604 to return to the uncompressed state, causing the paths to expand, drawing air into the paths through the groove inlets (indicated by arrow L).

FIGS. 19-27 illustrate an exemplary embodiment of a ventilation system 1100 for an article of footwear. As shown in FIGS. 19-20, ventilation system 1100 may include a sole layer 1102 and a sockliner 1104 configured to lie on top of sole layer 1102. As discussed in more detail below, sole layer 1102 may include multiple reservoirs and grooves.

As previously stated, the sole layer may be any type of sole layer. FIG. 20 shows sole layer 1102 and sockliner 1104 assembled in an article of footwear having an upper 1296 and an outsole 1298.

Sole layer 1102 may include a forefoot region 1118, a heel region 1120 disposed opposite forefoot region 1118, and a midfoot region 1130 disposed between forefoot region 1118 and heel region 1120. Sole layer 1202 may include edges disposed about the perimeter of sole layer 1202. Sole layer 1102 may include a forward edge 1114 in forefoot region 1118 and a rearward edge 1116 in heel region 1120. Sole layer 1102 may include a medial side 1122 and a lateral side 1124 disposed opposite medial side 1122. A longitudinal axis C may extend through sole layer 1102 between medial side 1122 and lateral side 1124. Sole layer 1102 may include a medial edge 1126 along medial side 1122 and a lateral edge 1128 along lateral side 1124.

In some embodiments, sole layer 1102 may have a lip 1176 disposed along the perimeter of sole layer 1102. The height of lip 1176 may vary along the perimeter of sole layer 1102. For example, as shown in FIG. 19, lip 1176 may have a greater height in heel region 1120 than in forefoot region 1118. Sole layer 1102 may have a top surface 1174 and a bottom surface 1103.

Sole layer 1102 may include paths formed by grooves. For example, sole layer 1102 may include paths formed by a first groove 1113, a second groove 1115, a third groove 1117, a fourth groove 1138, a fifth groove 1140, and a sixth groove 1142. Sole layer 1102 may include a plurality of reservoirs each connecting one groove to another. For example, sole layer 1102 may include a first reservoir 1132, a second reservoir 1134, and a third reservoir 1136. First groove 1113 may be connected to fourth groove 1138 by first reservoir 1132. Second groove 1115 may be connected to fifth groove 1140 by second reservoir 1134. Third groove 1117 may be connected to sixth groove 1142 by third reservoir 1136. Each reservoir may have a first side closer to rearward edge 1116 than forward edge 1114 and a second side disposed opposite the first side. One or more grooves may be disposed between an air inlet and the first side of each reservoir. For example, first groove 1113 may be disposed between an inlet and a first side of first reservoir 1132. Second groove 1115 may be disposed between an inlet and a first side of second reservoir 1134. Third groove 1117 may be disposed between an inlet and a first side of third reservoir 1136. The groove inlets may be configured to allow air to enter the grooves. For example, the groove inlets may extend through an edge to the corresponding groove.

One or more grooves may extend from the second side of each reservoir and terminate at a point between the second side and forward edge 1114. For example, fourth groove 1138 may extend from a second side of first reservoir 1132 and terminate at a point between the second side and forward edge 1114. Fifth groove 1140 may extend from a second side of second reservoir 1134 and terminate at a point between the second side and forward edge 1114. Sixth groove 1142 may extend from a second side of third reservoir 1136 and terminate at a point between the second side and forward edge 1114.

In some embodiments, as shown in FIG. 19, first groove inlet 1106, second groove inlet 1108, and third groove inlet 1110 may all be disposed on medial side 1122 in heel region 1120. The space between first groove 1113, second groove 1115, and third groove 1117 may increase from rearward edge 1116 toward forward edge 1114. Similarly, the space between fourth groove 1138, fifth groove 1140, and sixth groove 1142 may increase from rearward edge 1116 toward forward edge 1114. In some embodiments, one or more of fourth groove 1138, fifth groove 1140, and sixth groove 1142 may terminate in midfoot region 1130 instead of forefoot region 1118. In some embodiments, individual grooves may terminate in different regions of sole layer 1102 from one another. The path of the grooves may also extend in different directions from those shown in FIGS. 19-27. The path of the grooves, including the location of the air inlet and termination, may be selected based on a variety of factors. For example, the path of the grooves may be selected based on the use of the article of footwear.

FIG. 19 shows single grooves disposed between each reservoir and an inlet located at an edge of a sole layer. However, in some embodiments, multiple grooves may be disposed between each reservoir and inlets located at an edge of a sole layer. For example, two to ten grooves may be disposed between a reservoir and inlets located at an edge of a sole layer. Similarly, the number of grooves between each reservoir and forward edge 1114 may vary. For example, two to ten grooves may be disposed between a reservoir and forward edge 1114. The size, shape, and number of grooves may be selected based on a variety of factors. For example, the number of grooves may be selected based on the size and shape of the reservoir.

In some embodiments, as shown in FIG. 19, the reservoirs may be disposed in midfoot region 1130. The reservoirs may be disposed in midfoot region 1130 adjacent heel region 1120. Such a placement may allow the grooves disposed in heel region 1120 to be compressed before compressing the reservoirs when a wearer takes a step forward. Compressing the grooves disposed in heel region 1120 before the compressing reservoirs may close off the connection between the reservoirs and the inlets such that air may be forced into the grooves disposed between the reservoirs and the forward edge. First reservoir 1132 may be closer to forward edge 1114 than second reservoir 1134. Second reservoir 1134 may be closer to forward edge 1114 than third reservoir 1136. In some embodiments, the reservoirs may be disposed in forefoot region 1118 or heel region 1120. In some embodiments, individual reservoirs may be positioned in different regions of sole layer 1102 from each other. For example, a first reservoir may be disposed in midfoot region 1130 and a second reservoir may be disposed in forefoot region 1118. In some embodiments, as shown in FIG. 19, first reservoir 1132 may be disposed on lateral side 1124. A first portion of second reservoir 1134 may be disposed on lateral side 1124 and a second portion of second reservoir 1134 may be disposed on medial side 1122. Third reservoir 1136 may be disposed on medial side 1122. In some embodiments, the reservoirs may be positioned differently with respect to lateral side 1124 and medial side 1122 than the reservoirs are shown in FIG. 19. In some embodiments, as shown in FIG. 19, the reservoirs may be substantially oval. In some embodiments, the reservoirs may each have a different size and/or shape from one another. For example, one reservoir may be oval and another reservoir may be rectangular. While FIG. 19 shows three reservoirs, sole layer 1102 may include a different number of reservoirs. For example, sole layer 1102 may include one to ten reservoirs. The location, size, shape, and number of reservoirs may be selected based on a variety of factors. For example, the number of reservoirs may be selected based on the activity the shoe is worn for or the position of the grooves.

Sockliner 1104 may include a forefoot region 1168, a heel region 1170 opposite forefoot region 1168, and midfoot region 1172 between forefoot region 1168 and heel region 1170. Sockliner 1104 may include a medial side 1164 and a lateral side 1166 disposed opposite medial side 1164. In some embodiments, sockliner 1104 may have a lip corresponding to lip 1176 of sole layer 1102. Sockliner 1104 may include one or more openings through which air may be introduced into the interior of the article of footwear. In some embodiments, sockliner 1104 may include one or more openings overlying the grooves. For example, as shown in FIG. 19, openings 1156, openings 1158, and openings 1160 may be disposed in forefoot region 1168. Openings 1156 may overlie fourth groove 1138 such that air may enter fourth groove 1138 from first reservoir 1132 and may exit fourth groove 1138 through openings 1156 into the interior of the article of footwear. Openings 1158 may overlie fifth groove 1140 such that air may enter fifth groove 1140 from second reservoir 1134 and may exit fifth groove 1140 through openings 1158 into the interior of the article of footwear. Openings 1160 may overlie sixth groove 1142 such that air may enter sixth groove 1142 from third reservoir 1136 and may exit sixth groove 1142 through openings 1160 into the interior of the article of footwear.

While FIG. 19 shows seven openings per groove, sockliner 1104 may include any number of openings per groove. For example, sockliner 1104 may include from one to thirty openings per groove. The number of openings may be selected based on a variety of factors. For example, the number of openings may be selected based on the size of the groove, the size of the groove inlet, and/or the material of the sockliner. The number of openings may be the same or different for each groove. In some embodiments, sole layer 1102 may include openings that do not overlie grooves.

Figure 25:
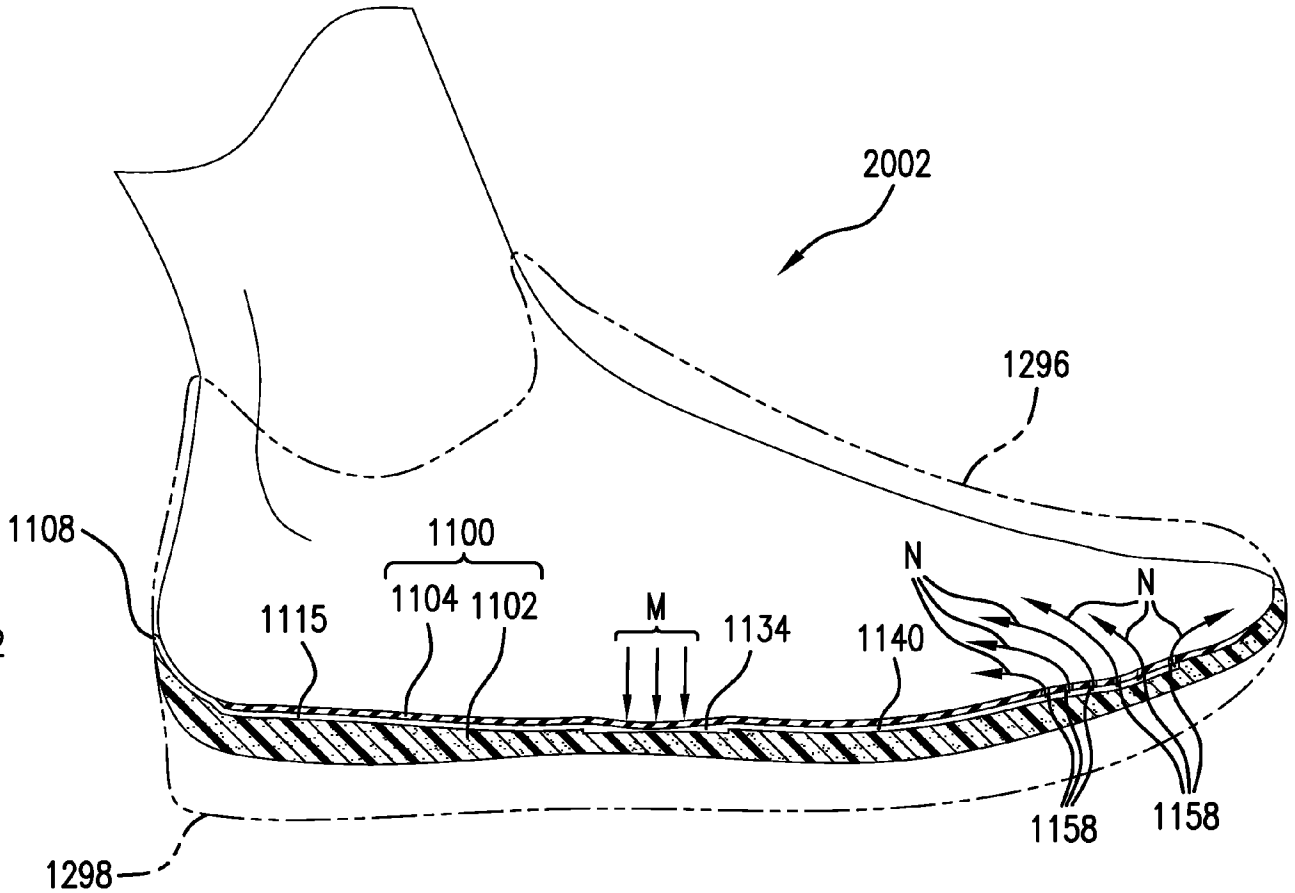
FIG. 25 is a detailed view of the article of footwear shown in FIG. 24.
Figure 24:
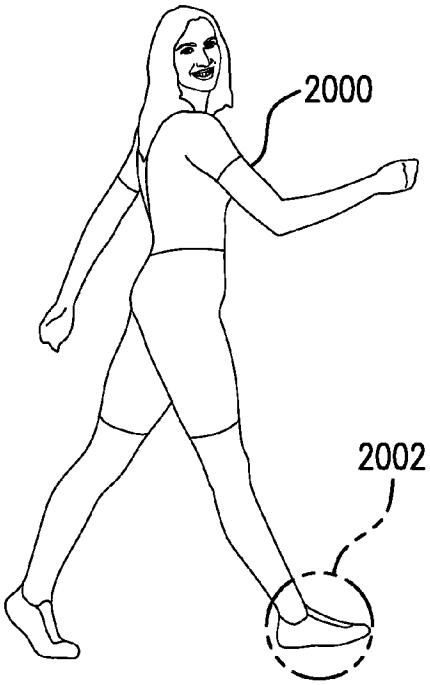
FIG. 24 is a person stepping down while wearing an article of footwear incorporating an exemplary embodiment of a ventilation system.

FIGS. 24-27 display ventilation system 1100 in action. In FIGS. 25-25, a wearer 2000 is wearing an article of footwear 2002 incorporating ventilation system 1100. For simplicity, second groove 1115, fifth groove 1140, reservoir 1134, and openings 1158 are shown, but it is understood that any of the paths, reservoirs, and outlets may behave as shown in FIGS. 24-27. FIGS. 24-25 show wearer 2000 taking a step forward with her right foot. As wearer 2000 steps forward, her weight shifts to midfoot region 1130, as indicated by arrows M. The pressure of the wearer's weight may cause the portion of sole layer 1102 underlying the wearer's weight to compress midfoot region 1130 adjacent heel region 1120. In some embodiments, the pressure of the wearer's weight may cause the portion of sockliner 1104 underlying the wearer's weight to compress. While the drawings show sole layer 1102 and sockliner 1104 compressing near the arrows M, it is understood that sole layer 1102 and/or sockliner 1104 may compress at any other location experiencing pressure. The amount of compression may vary with the amount of pressure experienced by sole layer 1102 and/or sockliner 1104, as well as with the type of material used to make sole layer 1102 and/or sockliner 1104. As sole layer 1102 and/or sockliner 1104 compress, the paths disposed between sole layer 1102 and sockliner 1104 and the space between reservoir 1134 and sockliner 1104 may decrease in volume, expelling air (indicated by arrows N) from the paths through openings 1158 into the interior of article of footwear 2002.

Figure 27:
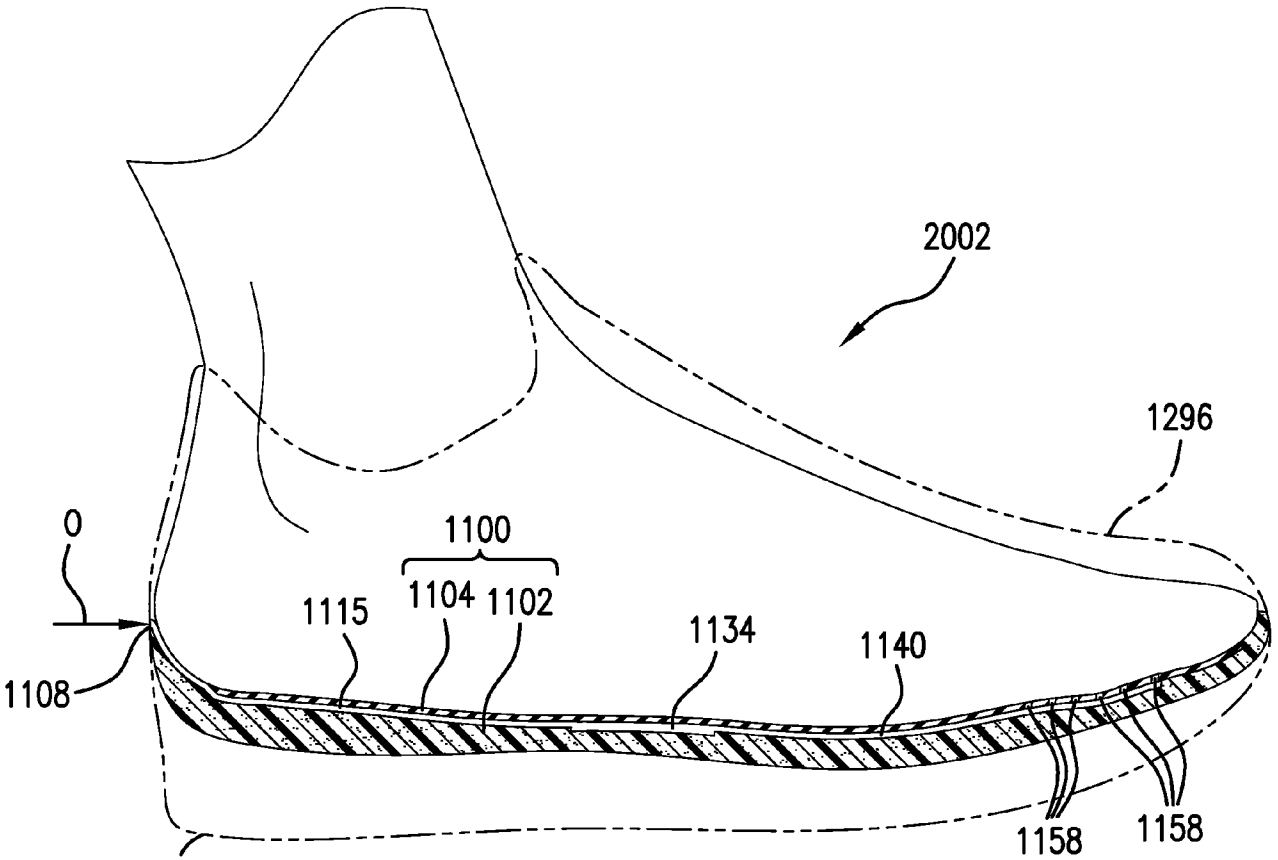
FIG. 27 is a detailed view of the article of footwear shown in FIG. 26.
Figure 26:
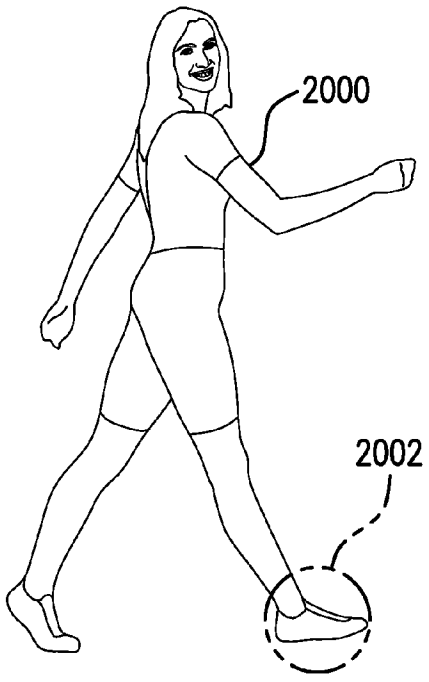
FIG. 26 is the person of FIG. 24 lifting a foot while wearing an article of footwear incorporating an exemplary embodiment of a ventilation system.

FIGS. 26-27 show wearer 2000 immediately after taking a step forward with her right foot such that her right foot is now in the air. In this position, the wearer's weight no longer compresses sole layer 1102 and/or sockliner 1104. The resilience of the material of sole layer 1102 and/or sockliner 1104 may cause sole layer 1102 and/or sockliner 1104 to return to the uncompressed state, causing the paths to expand, drawing air into the paths through the groove inlets (indicated by arrow O).

Figure 29:
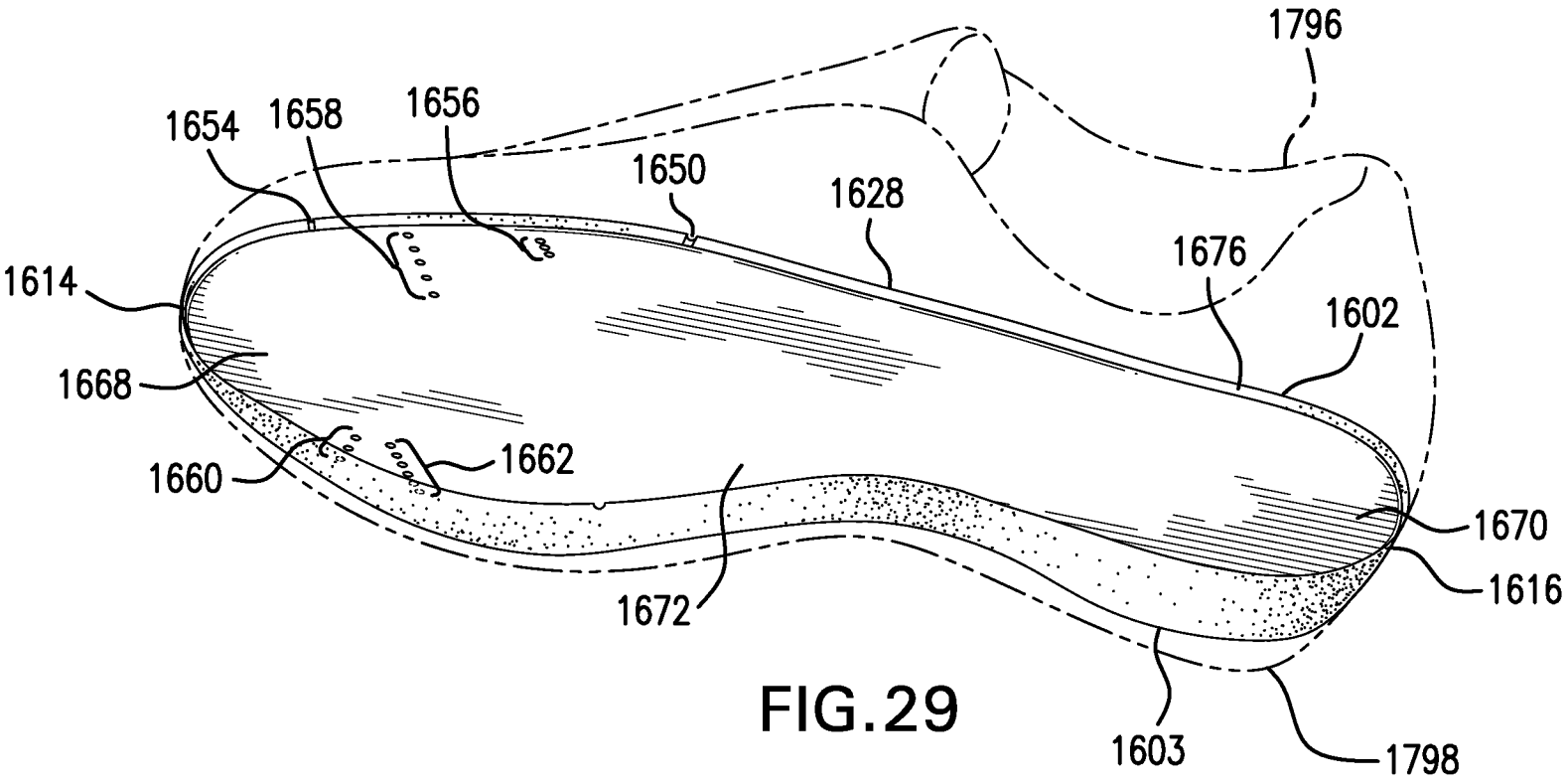
FIG. 29 is a view of the exemplary embodiment shown in FIG. 28 after assembly.

FIGS. 28-33 illustrate an exemplary embodiment of a ventilation system 1600 for an article of footwear. As shown in FIG. 28, ventilation system 1600 may include a sole layer 1602 and a sockliner 1604 configured to lie on top of sole layer 1602. As previously stated, the sole layer may be any type of sole layer. FIG. 29 shows sole layer 1602 and sockliner 1604 assembled in an article of footwear having an upper 1796 and an outsole 1798.

Sole layer 1602 may include a plurality of reservoirs and paths arranged in a forefoot region such that a wearer's metatarsophalangeal joint overlies the reservoirs and paths. Such an arrangement may cause a wearer's weight to be concentrated over the plurality of reservoirs and paths.

Sole layer 1602 may include a forefoot region 1618, a heel region 1620 disposed opposite forefoot region 1618, and a midfoot region 1630 disposed between forefoot region 1618 and heel region 1620. Sole layer 1602 may include edges disposed about the perimeter of sole layer 1602. Sole layer 1602 may include a forward edge 1614 in forefoot region 1618 and a rearward edge 1616 in heel region 1620. Sole layer 1602 may include a medial side 1622 and a lateral side 1624 disposed opposite medial side 1622. A longitudinal axis D may extend through sole layer 1602 between medial side 1622 and lateral side 1624. Sole layer 1602 may include a medial edge 1626 along medial side 1622 and a lateral edge 1628 along lateral side 1624.

In some embodiments, sole layer 1602 may have a lip 1676 disposed along the perimeter of sole layer 1602. The height of lip 1676 may vary along the perimeter of sole layer 1602. For example, as shown in FIG. 28, lip 1676 may have a greater height in heel region 1620 than in forefoot region 1618. Sole layer 1602 may have a top surface 1674 and a bottom surface 1603.

Sole layer 1602 may include paths formed by grooves. For example, sole layer 1602 may include paths formed by a first groove 1608, a second groove 1610, a third groove 1612, a fourth groove 1638, a fifth groove 1640, a sixth groove 1642, seventh groove 1644, eighth groove 1646, and ninth groove 1648. These grooves may be disposed in forefoot region 1618. Sole layer 1602 may include a plurality of reservoirs each connecting one groove to another. For example, sole layer 1602 may include a first reservoir 1632, a second reservoir 1634, and a third reservoir 1636. First groove 1608, second groove 1610, and third groove 1612 may each be connected to one another by first reservoir 1632. Third groove 1612, fourth groove 1638, fifth groove 1640, and sixth groove 1642 may each be connected to one another by second reservoir 1634. Sixth groove 1642, seventh groove 1644, eighth groove 1646, and ninth groove 1648 may each be connected to one another by third reservoir 1636.

First reservoir 1632, second reservoir 1634, and third reservoir 1636 may be disposed in forefoot region 1618 in positions that align with a wearer's metatarsophalangeal joint such that the reservoirs may be compressed when the wearer's weight is shifted to his metatarsophalangeal joint. For example, first reservoir 1632 may be substantially aligned with the wearer's fourth and fifth metatarsophalangeal joints. First reservoir 1632 may be closer to lateral edge 1628 and midfoot region 1630 than second reservoir 1634. Second reservoir 1634 may be substantially aligned with the wearer's third and fourth metatarsophalangeal joints. Second reservoir 1634 may be closer to lateral edge 1628 and midfoot region 1630 than third reservoir 1636. Third reservoir 1636 may be substantially aligned with the wearer's first and second metatarsophalangeal joints.

First groove 1608 may extend from a first groove inlet 1650, disposed on lateral edge 1628, to first reservoir 1632. First groove 1608 may provide a path for air to enter from exterior of the article of footwear to first reservoir 1632. First groove inlet 1650 may be configured to allow air to enter first groove 1608. For example, first groove inlet 1650 may extend through an edge to the corresponding groove. Second groove 1610 may extend from a point adjacent lateral edge 1628 to first reservoir 1632. In some embodiments, as shown in FIG. 28, first groove 1608 may have an inlet and second groove 1610 may not have an inlet. In other embodiments, second groove 1610 may have an inlet and first groove 1608 may or may not have an inlet.

Third groove 1612 may extend from first reservoir 1632 to second reservoir 1634 such that third groove 1612 connects first reservoir 1632 to second reservoir 1634. Sixth groove 1642 may extend from second reservoir 1634 to third reservoir 1636 such that sixth groove 1642 connects second reservoir 1634 to third reservoir 1636. Fourth groove 1638 may extend from a point adjacent lateral edge 1628 to second reservoir 1634. Fifth groove 1640 may extend from a fifth groove inlet 1655, disposed on medial edge 1626, to second reservoir 1634. The groove inlet may be configured to allow air to enter the groove. For example, the groove inlet may extend through an edge of the corresponding groove. Fifth groove 1640 may provide a path for air to enter from exterior of the article of footwear to second reservoir 1634. In some embodiments, as shown in FIG. 28, fourth groove 1638 may have an inlet and fifth groove 1640 may not have an inlet. In other embodiments, fifth groove 1640 may have an inlet and fourth groove 1638 may or may not have an inlet.

Eighth groove 1646 may extend from an eighth groove inlet 1654, disposed on lateral edge 1628, to eighth reservoir 1646. Eighth groove inlet 1654 may provide a path for air to enter from exterior of the article of footwear to eighth groove 1646. Seventh groove 1644 may extend from a point adjacent medial edge 1626 to third reservoir 1636. Ninth groove 1648 may extend from a point adjacent medial edge 1626 to third reservoir 1636. In some embodiments, one or more of seventh groove 1644, ninth groove 1648, and eighth groove 1646 may have inlets. For example, as shown in FIG. 28, eighth groove 1646 may have an inlet, and seventh groove 1644 and ninth groove 1648 may not have inlets.

In some embodiments, the reservoirs may be positioned differently with respect to lateral side 1624 and medial side 1622 than the reservoirs are shown in FIG. 28. In some embodiments, as shown in FIG. 28, the reservoirs may be substantially circular. In some embodiments, the reservoirs may each have a different size and/or shape from one another. For example, one reservoir may be oval and another reservoir may be rectangular. While FIG. 28 shows three reservoirs, sole layer 1602 may include a different number of reservoirs. For example, sole layer 1602 may include one to ten reservoirs. The location, size, shape, and number of reservoirs may be selected based on a variety of factors. For example, the number of reservoirs may be selected based on the distribution of pressure applied to the sole layer when a wearer takes a step. The thickness of sole layer 1602 and the depth of the grooves and reservoirs may be similar to those shown in other embodiments.

Sockliner 1604 may include a forefoot region 1668, a heel region 1670 opposite forefoot region 1668, and midfoot region 1672 between forefoot region 1668 and heel region 1670. Sockliner 1604 may include a medial side 1664 and a lateral side 1666 disposed opposite medial side 1664. In some embodiments, sockliner 1604 may have a lip corresponding to lip 1676 of sole layer 1602. Sockliner 1604 may include one or more openings through which air may be introduced into the interior of the article of footwear. In some embodiments, sockliner 1604 may include one or more openings overlying the grooves. For example, as shown in FIG. 28, openings 1656, openings 1658, openings 1660, and openings 1662 may be disposed in forefoot region 1668. Openings 1656 may overlie second groove 1610 such that air may enter second groove 1610 from first reservoir 1632 and may exit second groove 1610 through openings 1656 into the interior of the article of footwear. Openings 1658 may overlie fourth groove 1638 such that air may enter fourth groove 1638 from second reservoir 1634 and may exit fourth groove 1638 through openings 1668 into the interior of the article of footwear. Openings 1660 may overlie ninth groove 1648 such that air may enter ninth groove 1648 from third reservoir 1636 and may exit ninth groove 1648 through openings 1660 into the interior of the article of footwear. Openings 1662 may overlie seventh groove 1644 such that air may enter seventh groove 1644 from third reservoir 1636 and may exit seventh groove 1644 through openings 1662 into the interior of the article of footwear.

As shown in FIG. 28, the number of openings may be the same or different for each groove. For example, fifth groove 1640 may align with seven grooves while third groove 1638 may align with five grooves. In other embodiments, the number of openings aligning with grooves may be same for each groove. Sockliner 1604 may include any number of openings per groove. For example, sockliner 1604 may include from one to thirty openings per groove. The number of openings may be selected based on a variety of factors. For example, the number of openings may be selected based on the size of the groove, the size of the groove inlet, and/or the material of the sockliner. In some embodiments, sole layer 1602 may include openings that do not overlie grooves. In some embodiments, the openings may overlie different grooves from those shown in FIG. 28.

Figure 31:
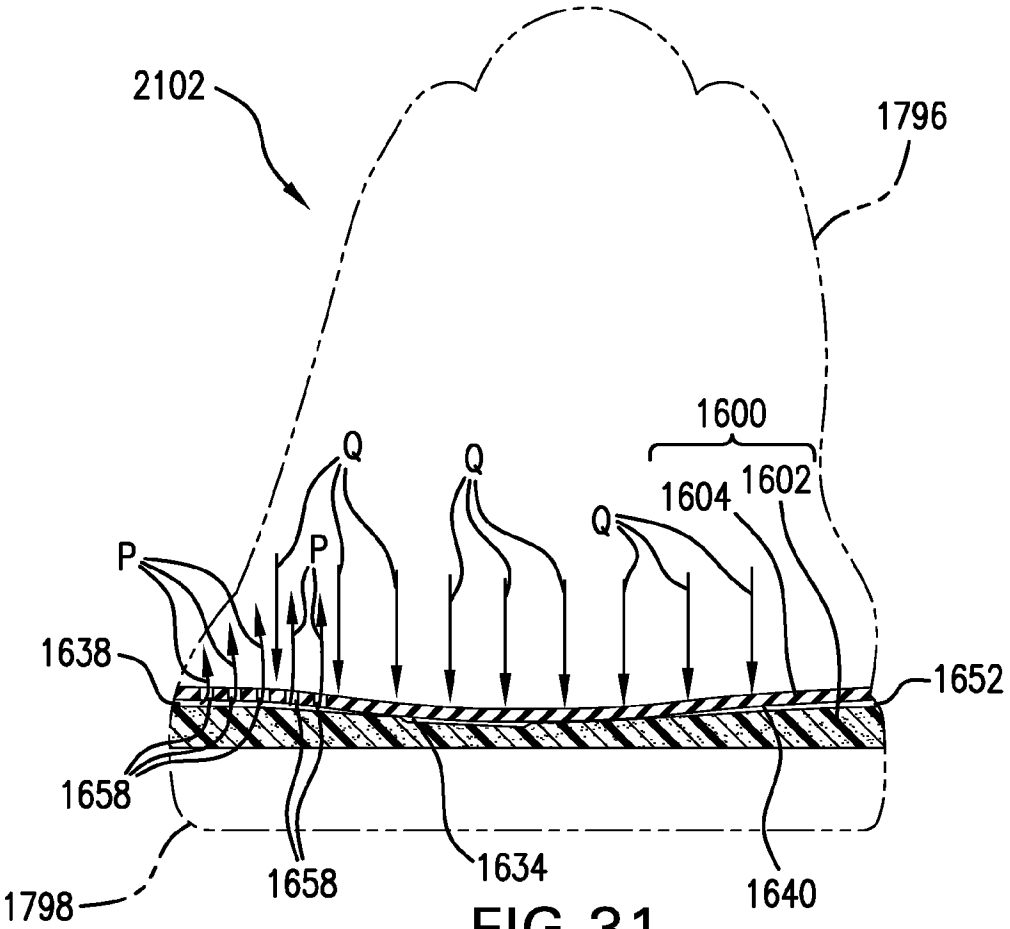
FIG. 31 is a detailed view of the article of footwear shown in FIG. 30 shown along section line 31-31.
Figure 30:
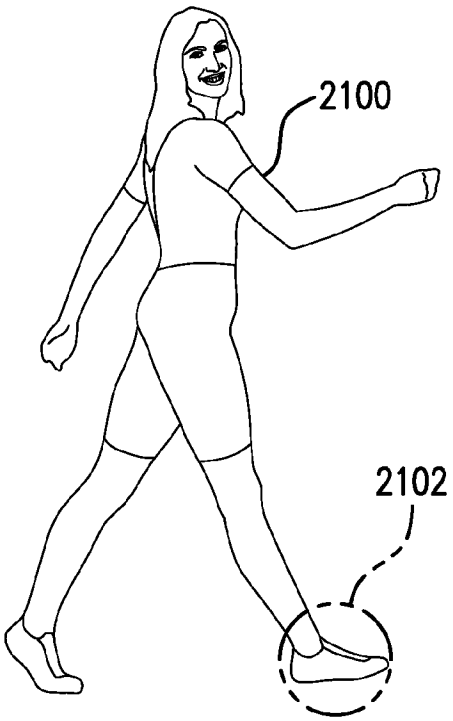
FIG. 30 is a person stepping down while wearing an article of footwear incorporating an exemplary embodiment of a ventilation system.

FIGS. 30-33 display ventilation system 1600 in action. In FIGS. 30-31, a wearer 2100 is wearing an article of footwear incorporating ventilation system 1600. For simplicity, fourth groove 1638, fifth groove 1640, reservoir 1634, and openings 1658 are shown, but it is understood that any of the paths, reservoirs, and outlets may behave as shown in FIGS. 30-33. FIGS. 30-31 show wearer 2000 taking a step forward with her right foot. As wearer 2100 steps forward, her weight shifts to forefoot region 1618, as indicated by arrows Q. For example, the wearer's weight may shift to her metatarsophalangeal joint. The pressure of the wearer's weight may cause the portion of sole layer 1602 underlying the wearer's weight to compress forefoot region 1618. In some embodiments, the pressure of the wearer's weight may cause the portion of sockliner 1604 underlying the wearer's weight to compress. While the drawings show sole layer 1602 and sockliner 1604 compressing near the arrows Q, it is understood that sole layer 1602 and/or sockliner 1604 may compress at any other location experiencing pressure. The amount of compression may vary with the amount of pressure experienced by sole layer 1602 and/or sockliner 1604, as well as with the type of material used to make sole layer 1602 and/or sockliner 1604. As sole layer 1602 and/or sockliner 1604 compress, the paths disposed between sole layer 1602 and sockliner 1604 and the space between reservoir 1634 and sockliner 1604 may decrease in volume, expelling air (indicated by arrows P) from the paths through openings 1658 into the interior of article of footwear 2102.

Figure 33:
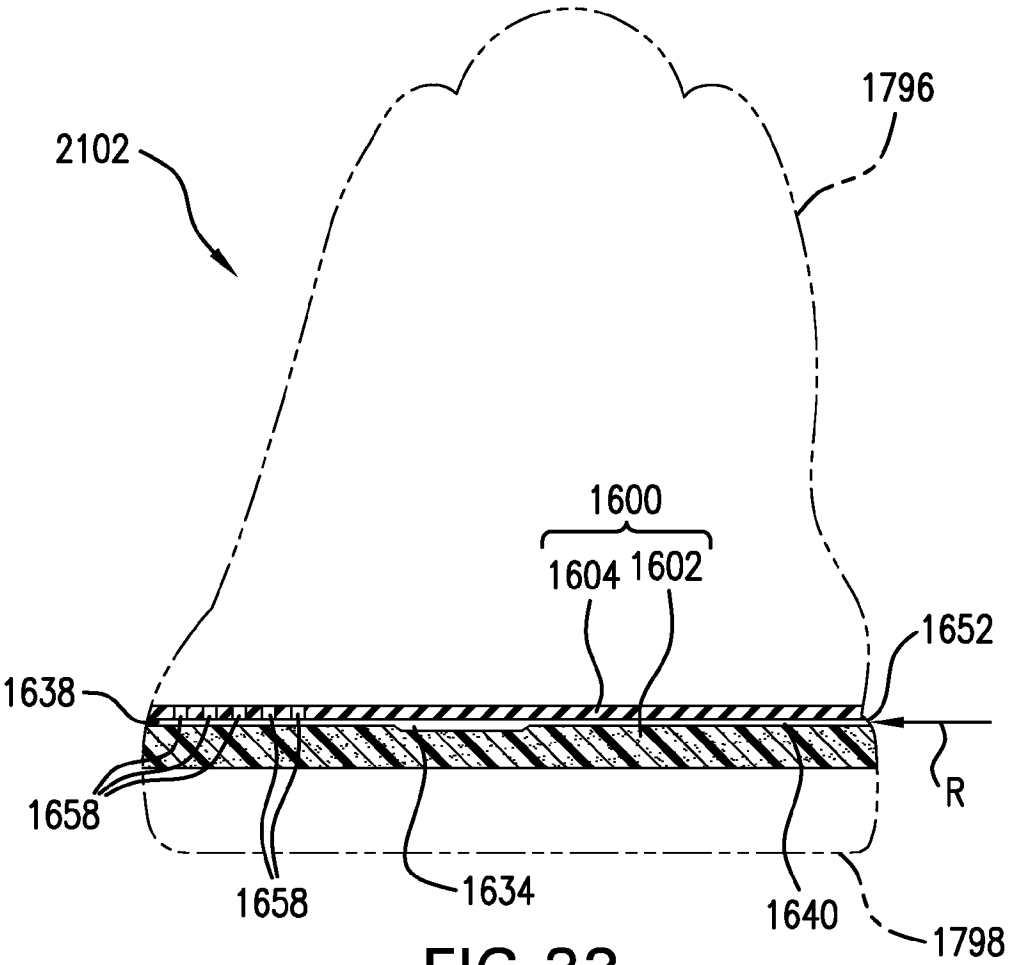
FIG. 33 is a detailed view of the article of footwear shown in FIG. 26 shown along section line 31-31.
Figure 32:
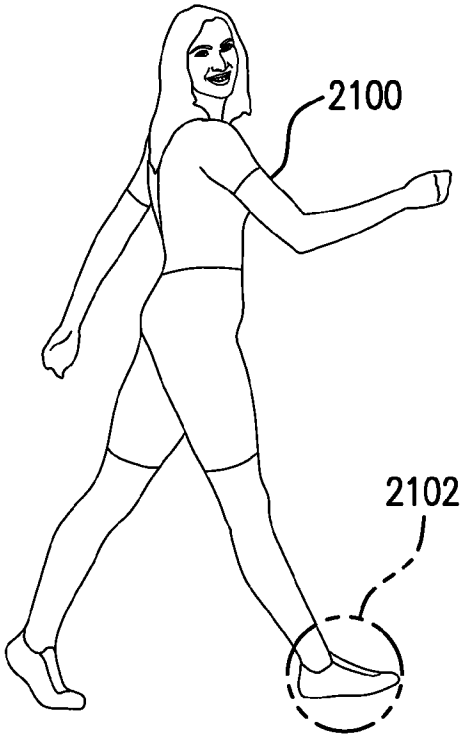
FIG. 32 is the person of FIG. 30 lifting a foot while wearing an article of footwear incorporating an exemplary embodiment of a ventilation system.

FIGS. 32-33 show wearer 2100 immediately after taking a step forward with her right foot such that her right foot is now in the air. In this position, the wearer's weight no longer compresses sole layer 1602 and/or sockliner 1604. The resilience of the material of sole layer 1602 and/or sockliner 1604 may cause sole layer 1602 and/or sockliner 1604 to return to the uncompressed state, causing the paths to expand, drawing air into the paths through the groove inlets (indicated by arrow R).

In some embodiments, the sole layer or another layer beneath the sole layer, such as an outsole, may include protrusions aligning with the reservoirs and/or grooves such that the protrusions help compress the reservoirs and/or grooves under the pressure of a wearer's weight.

Components of the disclosed embodiments may be incorporated into any embodiment of the ventilation system. In other words, components may be combined and/or substituted for one another.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A ventilation system for an article of footwear, comprising:

a sole layer having a forefoot region, a heel region disposed opposite the forefoot region, and a midfoot region disposed between the forefoot region and the heel region, wherein the sole layer has a first groove inlet extending through an edge of the sole layer, a first groove formed in a top surface of the sole layer, a second groove formed in a top surface of the sole layer, and a first reservoir formed in the top surface of the sole layer, wherein the first groove inlet is disposed in the heel region and the first groove extends from the first groove inlet and terminates at a first side of the first reservoir, and wherein the second groove extends from a second side of the first reservoir that is opposite the first side of the first reservoir and terminates between the second side of the first reservoir and a forward edge of the sole layer;

the first reservoir being disposed in the midfoot region of the sole layer and the first reservoir being spaced from the heel region;

the first groove extending through the heel region such that the first groove is configured to receive a compressive force from a heel strike of a wearer;

wherein the first groove is configured to close a connection between the first reservoir and the first groove inlet when the first groove is compressed;

wherein the compressive force forces air to flow from the first reservoir to the second groove.

2. The ventilation system according to claim 1, wherein the first groove inlet is disposed through a rearward edge of the sole layer.

3. The ventilation system according to claim 1, wherein the second groove terminates in the forefoot region.

4. The ventilation system according to claim 1, further comprising:

a third groove formed in the top surface of the sole layer, the third groove extending from a second groove inlet and terminating at the first side of the first reservoir.

5. The ventilation system according to claim 4, further comprising:

a fourth groove and a fifth groove each disposed in the top surface of the sole layer, the fourth groove and the fifth groove each extending from the second side of the first reservoir and terminating between the second side of the first reservoir and the forward edge of the sole layer.

6. The ventilation system according to claim 5, wherein the fourth groove is a mirror image of the second groove.

7. The ventilation system according to claim 1, further comprising:

a sockliner configured to be disposed over the sole layer, the sockliner having at least one hole overlying the second groove.

8. The ventilation system according to claim 1, further comprising:

a second reservoir and a third groove each formed on the top surface of the sole layer, wherein the third groove extends from a second groove inlet disposed through a rearward edge of the sole layer to a first side of the second reservoir.

9. The ventilation system according to claim 8, wherein the third groove is substantially parallel to the first groove.

10. A ventilation system for an article of footwear, comprising:

a sole layer having a forefoot region, a heel region disposed opposite the forefoot region, and a midfoot region disposed between the forefoot region and the heel region, the sole layer also having a medial side and a lateral side;

wherein the sole layer has a first groove inlet extending through an edge of the sole layer, a first groove, a second groove, and a first reservoir each formed in a top surface of the sole layer;

wherein the first reservoir is located along the lateral side of the sole layer;

wherein the first groove extends from the first groove inlet and terminates at a first side of the first reservoir; and wherein the second groove extends from a second side of the first reservoir that is opposite the first side of the first reservoir and terminates between the second side of the first reservoir and a forward edge of the sole layer;

the first reservoir being disposed in the midfoot region of the sole layer and the first reservoir being spaced from the heel region;

the first groove extending through the heel region such that the first groove is configured to receive a compressive force from a heel strike of a wearer;

wherein the first groove is configured to close a connection between the first reservoir and the first groove inlet when the first groove is compressed;

wherein the compressive force forces air to flow from the first reservoir to the second groove.

11. The ventilation system according to claim 1, wherein the second groove extends through a central area of the forefoot region of the sole layer.

12. The ventilation system according to claim 1, wherein sole layer is made of a resilient material configured to provide cushioning.

13. The ventilation system according to claim 8, further comprising a fourth groove, the fourth groove extending from a second side of the second reservoir that is opposite the first side of the second reservoir and terminates between the second side of the second reservoir and the forward edge of the sole layer;

wherein the second reservoir is spaced from the first reservoir, and wherein the second groove inlet is spaced from the first groove inlet.

14. The ventilation system according to claim 10, further comprising, a second groove inlet extending through the edge of the sole layer, a third groove, a fourth groove, and a second reservoir each formed in a top surface of the sole layer;

the third groove extending from the second groove inlet and terminating at a first side of the second reservoir;

the first groove inlet being located in the heel region and the second groove inlet also being located in the heel region;

the first reservoir being positioned closer to the forefoot region than the second reservoir;

the first reservoir being spaced from the second reservoir.

15. The ventilation system according to claim 14, wherein the third groove extends through the heel region;

the second reservoir being disposed in the midfoot region of the sole layer and the second reservoir being spaced from the heel region;

the third groove extending through the heel region such that the third groove is configured to receive a compressive force from a heel strike of a wearer;

wherein the third groove is configured to close a connection between the second reservoir and the second groove inlet when the third groove is compressed;

wherein the compressive force forces air to flow from the first reservoir to the second groove.

16. The ventilation system according to claim 14, wherein the first groove inlet, the first groove, the first reservoir and the second groove form a first path;

wherein the second groove inlet, the third groove, the second reservoir, and the fourth groove form a second path; and wherein the first path is separate from the second path.

17. The ventilation system according to claim 10, wherein the sole layer is made of a resilient material configured to provide cushioning.

* * * * *